US011676534B2

(12) United States Patent
Kim et al.

(10) Patent No.: US 11,676,534 B2
(45) Date of Patent: Jun. 13, 2023

(54) LIGHT EMITTING DISPLAY DEVICE AND METHOD FOR DRIVING IHE SAME

(71) Applicant: LG DISPLAY CO., LTD., Seoul (KR)

(72) Inventors: Hyuck Jun Kim, Paju-si (KR); Dong Kyun Woo, Goyang-si (KR); Tae Young Lee, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/541,544

(22) Filed: Dec. 3, 2021

(65) Prior Publication Data

US 2022/0199017 A1 Jun. 23, 2022

(30) Foreign Application Priority Data

Dec. 17, 2020 (KR) ..... 10-2020-0177115

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0842* (2013.01); *G09G 2310/08* (2013.01); *G09G 2320/0295* (2013.01); *G09G 2320/045* (2013.01)

(58) Field of Classification Search
CPC ..... G09G 3/3233; G09G 3/3275; G09G 2300/0842; G09G 2310/08; G09G 2320/0295; G09G 2320/045
See application file for complete search history.

(56) References Cited

U.S. PATENT DOCUMENTS 8,294,696 B2 * 10/2012 Min ..... G09G 3/3233 345/204
8,599,224 B2 * 12/2013 Yoo ..... G09G 3/3233 345/212
8,836,691 B2 * 9/2014 Ryu ..... G09G 3/3283 345/76
8,952,951 B2 * 2/2015 Yoo ..... G09G 5/00 345/212
9,129,554 B2 * 9/2015 Kim ..... G09G 3/3233
9,450,567 B2 * 9/2016 Kwon ..... H03H 19/004
10,283,043 B2 * 5/2019 Lee ..... G09G 3/3233
10,460,662 B2 * 10/2019 Song ..... G09G 3/006
10,665,173 B2 * 5/2020 In ..... G09G 3/3233
11,011,118 B2 * 5/2021 Lin ..... G09G 3/32
11,056,071 B2 * 7/2021 Ryu ..... G09G 3/3659
11,114,028 B2 * 9/2021 Yoon ..... G09G 3/3233
11,158,259 B2 * 10/2021 Wang ..... G09G 3/3233
(Continued)

FOREIGN PATENT DOCUMENTS

KR 10-2011-0032937 A 3/2011
KR 10-2018-0065678 A 6/2018
(Continued)

*Primary Examiner* — Michael J Jansen, II
(74) *Attorney, Agent, or Firm* — Polsinelli PC

(57) ABSTRACT

A light emitting display device includes a display panel configured to display an image, a driver configured to drive the display panel, and a compensation circuit configured to repeat a process of obtaining a sensing voltage from a sub-pixel included in the display panel, storing the sensing voltage, outputting the stored sensing voltage to the sub-pixel, and obtaining a sensing voltage from the sub-pixel to integrate the sensing voltage.

15 Claims, 26 Drawing Sheets

(a) (b)

(56) References Cited

U.S. PATENT DOCUMENTS

| | | | | |
|---|---|---|---|---|
| 11,361,710 | B2 * | 6/2022 | Yin | G09G 3/3266 |
| 2010/0073335 | A1 * | 3/2010 | Min | G09G 3/3291 345/204 |
| 2011/0007067 | A1 * | 1/2011 | Ryu | G09G 3/3233 345/76 |
| 2011/0084955 | A1 * | 4/2011 | Kim | G09G 3/3283 345/82 |
| 2011/0205250 | A1 * | 8/2011 | Yoo | G09G 3/3233 345/77 |
| 2011/0210958 | A1 * | 9/2011 | Yoo | G09G 3/325 345/76 |
| 2011/0216056 | A1 * | 9/2011 | Yoo | G09G 3/3233 345/212 |
| 2013/0147694 | A1 * | 6/2013 | Kim | G09G 3/3233 345/82 |
| 2014/0176625 | A1 * | 6/2014 | Yoon | G09G 3/3233 345/691 |
| 2015/0048881 | A1 * | 2/2015 | Kwon | H03H 19/004 327/554 |
| 2017/0039953 | A1 * | 2/2017 | Lee | G09G 3/3233 |
| 2017/0061877 | A1 * | 3/2017 | Lee | G09G 3/3258 |
| 2018/0144689 | A1 * | 5/2018 | Hong | G09G 3/3275 |
| 2018/0151112 | A1 * | 5/2018 | Song | G09G 3/3291 |
| 2018/0182346 | A1 * | 6/2018 | Ryu | G09G 3/3677 |
| 2019/0081261 | A1 * | 3/2019 | Lee | G09G 3/3233 |
| 2019/0385535 | A1 * | 12/2019 | In | G09G 3/3275 |
| 2020/0193905 | A1 * | 6/2020 | Yoon | G09G 3/3291 |
| 2022/0036818 | A1 * | 2/2022 | Yin | G09G 3/3233 |

FOREIGN PATENT DOCUMENTS

| | | | |
|---|---|---|---|
| KR | 10-2019-0009214 | A | 1/2019 |
| KR | 10-2019-0048397 | A | 5/2019 |

* cited by examiner

LIGHT EMITTING DISPLAY DEVICE AND METHOD FOR DRIVING IHE SAME

CROSS-REFERENCE TO RELATED APPLICATION

This application claims the benefit of Korean Patent Application No. 10-2020-0177115, filed on Dec. 17, 2020, which is hereby incorporated by reference in its entirety as if fully set forth herein.

BACKGROUND

Field of the Disclosure

The present disclosure relates to a light emitting display device and a method for driving the same.

Description of the Background

With the development of information technology, the market for display devices serving as connecting media between users and information is growing. Accordingly, display devices such as a light emitting display (LED), a quantum dot display (QDD), and a liquid crystal display (LCD) are increasingly used.

The aforementioned display devices include a display panel including sub-pixels, a driver that outputs driving signals for driving the display panel, and a power supply that generates power to be supplied to the display panel and the driver.

The display devices as described above can display images by transmitting light or directly emitting light through selected sub-pixels when driving signals, for example, a scan signal and a data signal, are supplied to sub-pixels formed in a display panel.

Among the aforementioned display devices, a light emitting display device has many advantages of electrical and optical characteristics of a high response speed, a high luminance, and a wide viewing angle, and mechanical characteristics that it can be implemented in a flexible form. However, the light emitting display device still has improvement points to be applied to various applications, and thus continuous research related thereto is required.

SUMMARY

Accordingly, the present disclosure is directed to a light emitting display device and a method for driving the same that substantially obviate one or more problems due to limitations and disadvantages.

The present disclosure is to provide a light emitting display device that improves sensing accuracy and compensation accuracy through a repeated and continuous split sensing operation at the time of driving a light emitting display device and to simplify a configuration of a circuit capable of performing real-time split sensing.

The present disclosure may provide a light emitting display device including a display panel configured to display an image, a driver configured to drive the display panel, and a compensation circuit configured to repeat a process of obtaining a sensing voltage from a sub-pixel included in the display panel, storing the sensing voltage, outputting the stored sensing voltage to the sub-pixel, and obtaining a sensing voltage from the sub-pixel to integrate the sensing voltage.

The compensation circuit may repeat a sensing operation of applying an initialization voltage to the sub-pixel, obtaining the sensing voltage from the sub-pixel, and outputting the sensing voltage in every blank period of the display panel.

The compensation circuit may obtain a first sensing voltage from the sub-pixel for a first blank period of the display panel, output the first sensing voltage obtained from the sub-pixel to the sub-pixel for a second blank period of the display panel, and then sense the sensing voltage to obtain a second sensing voltage higher than the first sensing voltage.

The compensation circuit may include a switch circuit configured to perform a switching operation for outputting the initialization voltage to the sub-pixel and a switching operation for repeatedly outputting and sensing the sensing voltage, an output circuit configured to amplify and output the initialization voltage or to amplify and output the sensing voltage, and a sensing circuit configured to store and integrate the sensing voltage.

The compensation circuit may include a first switch having a first electrode connected to a terminal through which the initialization voltage is output, a second electrode connected to a non-inverting terminal of an amplification circuit configured to amplify and output the initialization voltage, and a control electrode connected to a first control line, a second switch having a first electrode connected to an output terminal of the amplification circuit, a second electrode connected to an output channel, and a control electrode connected to a second control line, a third switch having a first electrode connected to the output channel, a second electrode connected to one terminal of a sampling circuit configured to store the sensing voltage, and a control electrode connected to a third control line, and a fourth switch having a first electrode connected to the non-inverting terminal of the amplification circuit, a second electrode connected to one terminal of the sampling circuit, and a control electrode connected to a fourth control line, wherein an inverting terminal and the output terminal of the amplification circuit may be commonly connected.

An output terminal of the compensation circuit may be connected to a reference line of the sub-pixel or a data line of the sub-pixel.

The compensation circuit may obtain the sensing voltage through a sensing node defined between a source electrode of a driving transistor and an organic light-emitting diode when a sensing transistor included in the sub-pixel is turned on.

The first switch may be turned on for an active period of the display panel, the second switch may be turned on for the active period and an initial period of a blank period of the display panel, the third switch may be turned on for a last period of the blank period of the display panel, and the fourth switch may be turned on for the initial period of the blank period of the display panel.

The sub-pixel may include an organic light-emitting diode emitting light, a driving transistor configured to generate a driving current to be supplied to the organic light-emitting diode, a capacitor having a first electrode connected to a gate electrode of the driving transistor, and a second electrode connected to an anode of the organic light-emitting diode, a switching transistor having a gate electrode connected to a first scan line, a first electrode connected to a first reference line, and a second electrode connected to the gate electrode of the driving transistor, and a sensing transistor having a gate electrode connected to the first scan line, a first electrode connected to a first data line, and a second electrode connected to the anode of the organic light-emitting diode.

In another aspect, the present disclosure may provide a light emitting display device including a display panel configured to display an image, a driver configured to drive the display panel, and a compensation circuit configured to repeat a process of applying an initialization voltage to a sub-pixel included in the display panel through a data line or a reference line, obtaining a sensing voltage, storing the sensing voltage, outputting the stored sensing voltage to the sub-pixel, and obtaining the sensing voltage to integrate the sensing voltage.

The compensation circuit may repeat a sensing operation of integrating the sensing voltage in every blank period of the display panel.

The compensation circuit may include a first switch having a first electrode connected to a terminal through which the initialization voltage is output, a second electrode connected to a non-inverting terminal of an amplification circuit configured to amplify and output the initialization voltage, and a control electrode connected to a first control line, a second switch having a first electrode connected to an output terminal of the amplification circuit, a second electrode connected to an output channel, and a control electrode connected to a second control line, a third switch having a first electrode connected to the output channel, a second electrode connected to one terminal of a sampling circuit configured to store the sensing voltage, and a control electrode connected to a third control line, and a fourth switch having a first electrode connected to the non-inverting terminal of the amplification circuit, a second electrode connected to one terminal of the sampling circuit, and a control electrode connected to a fourth control line, wherein an inverting terminal and the output terminal of the amplification circuit may be commonly connected.

In another aspect, the present disclosure may provide a method for driving a light emitting display device, including applying an initialization voltage through a sub-pixel for a first blank period of a display panel, obtaining a first sensing voltage from the sub-pixel and storing the first sensing voltage for the first blank period of the display panel, outputting the stored first sensing voltage to the sub-pixel for a second blank period of the display panel, and obtaining a second sensing voltage from the sub-pixel and storing the second sensing voltage for the second blank period of the display panel.

The second sensing voltage may have a level higher than the first sensing voltage.

The initialization voltage may be applied through a data line or a reference line of the sub-pixel.

BRIEF DESCRIPTION OF THE DRAWINGS

The accompanying drawings, which are included to provide a further understanding of the disclosure and are incorporated in and constitute a part of this application, illustrate aspect(s) of the disclosure and together with the description serve to explain the principle of the disclosure.

In the drawings.

DETAILED DESCRIPTION

Figure 1:
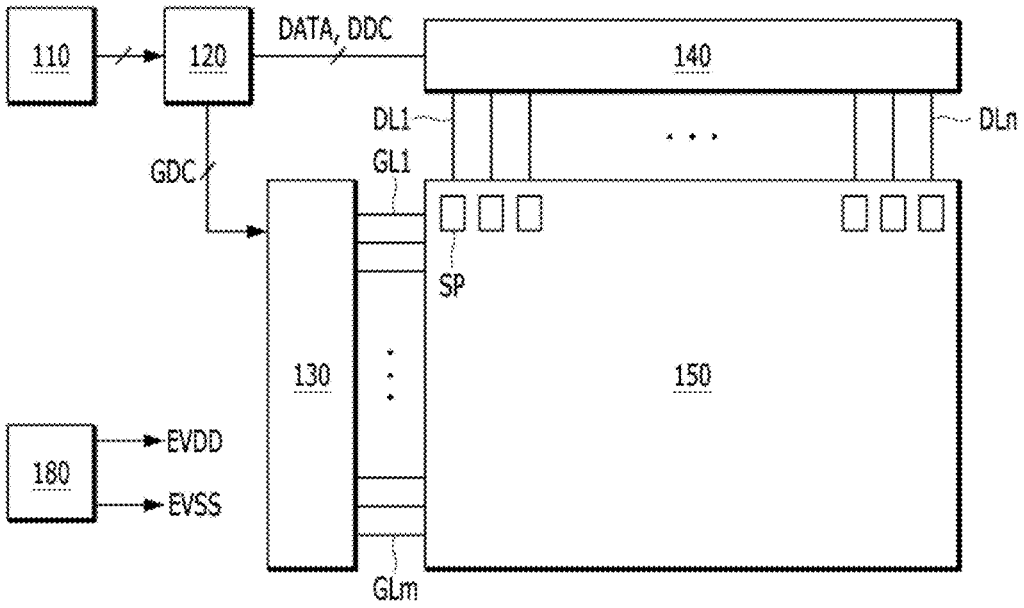
FIG. 1 is a block diagram schematically showing a configuration of a light emitting display device.
Figure 2:
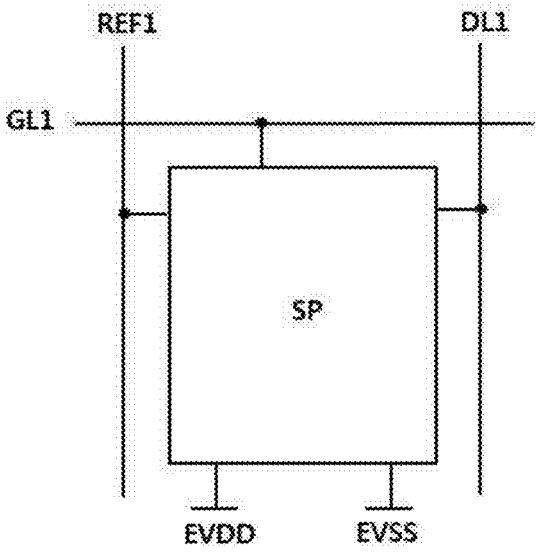
FIG. 2 is a block diagram schematically showing a configuration of a sub-pixel included in a display panel.
Figure 3:
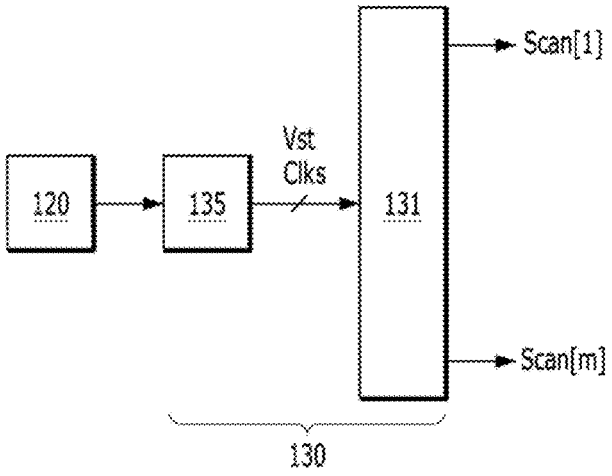
FIG. 3 illustrates a device configuration related to a gate-in-panel scan driver.

FIG. 1 is a block diagram schematically showing a configuration of a light emitting display device, FIG. 2 is a block diagram schematically showing a configuration of a sub-pixel included in a display panel, FIG. 3 illustrates a device configuration related to a gate-in-panel scan driver, and FIG. 4 illustrates arrangement of the gate-in-panel scan driver.

As illustrated in FIG. 1 to FIG. 4, the light emitting display device may include an image provider 110, a timing controller 120, a scan driver 130, a data driver 140, a display panel 150, and a power supply 180.

The image provider 110 (or a host system) may output various driving signals along with an image data signal supplied from the outside or an image data signal stored in an internal memory. The image provider 110 may provide a data signal and various driving signals to the timing controller 120.

The timing controller 120 may output a gate timing control signal GDC for controlling operation timing of the scan driver 130, a data timing control signal DDC for controlling operation timing of the data driver 140, and various synchronization signals (a vertical synchronization signal Vsync and a horizontal synchronization signal Hsync). The timing controller 120 may provide a data signal DATA supplied from the image provider 110 along with the data timing control signal DDC to the data driver 140. The timing controller 120 may be configured as an integrated circuit (IC) and may be mounted on a printed circuit board, but the present disclosure is not limited thereto.

The power supply 180 may generate first power at a high level and second power at a low level based on an external input voltage under the control of the timing controller 120 and output the first power and the second power through a first power line EVDD and a second power line EVSS. The power supply 180 may generate and output voltages (e.g., gate voltages including a gate high voltage and a gate low voltage) necessary for operation of the scan driver 130 and voltages (e.g., drain voltages including a drain voltage and a half drain voltage) necessary for operation of the data driver 140 as well as the first power and the second power.

The data driver 140 may sample and latch a data signal DATA in response to the data timing control signal DDC supplied from the timing controller 120, convert the data signal in a digital form into a data voltage in an analog form on the basis of a gamma reference voltage, and output the data voltage. The data driver 140 may provide the data voltage to sub-pixels included in the display panel 150 through data lines DL1 to DLn. The data driver 140 may be formed in the form of an IC and mounted on the display panel 150 or mounted on a printed circuit board, but the present disclosure is not limited thereto.

The display panel 150 may display an image in response to driving signals including a scan signal and a data voltage, the first power and the second power. Sub-pixels of the display panel 150 directly emit light. The display panel 150 may be manufactured based on a rigid or flexible substrate such as a glass substrate, a silicon substrate, or a polyimide substrate. The sub-pixels emitting light may include red, green and blue pixels or red, green, blue, and white pixels.

A single sub-pixel SP may be connected to a first reference line REF1, a first data line DL1, a first gate line GL1, the first power line EVDD, and the second power line EVSS. A single sub-pixel SP may include a switching transistor, a driving transistor, a capacitor, and an organic light emitting diode. A sub-pixel may include not only an organic light-emitting diode but also a compensation circuit for compensating for deterioration of a driving transistor that supplies a driving current to the organic light-emitting diode. This will be described below.

The scan driver 130 may output a scan signal (or a scan voltage) in response to the gate timing control signal GDC supplied from the timing controller 120. The scan driver 130 may provide the scan signal to the sub-pixels included in the display panel 150 through scan lines GL1 to GLm. The scan driver 130 may be formed in the form of an IC or directly formed on the display panel 150 in a gate in panel structure.

The gate-in-panel type scan driver 130 may include a shift register 131 and a level shifter 135. The level shifter 135 may generate and output one or more clock signals Clks and a start signal Vst based on signals output from the timing controller 120. The clock signals Clks may be generated and output in the form of K (K being an integer equal to or greater than 2) different phases such as 2 phases, 4 phases, or 8 phases.

The shift register 131 operates based on the signals Clks and Vst output from the level shifter 135 and may output scan signals Scan[1] to Scan[m] for turning on or off thin film transistors formed in the display panel 150. The shift register 131 is formed in the form of a thin film on the display panel 150 in a gate in panel structure.

Figure 4A:
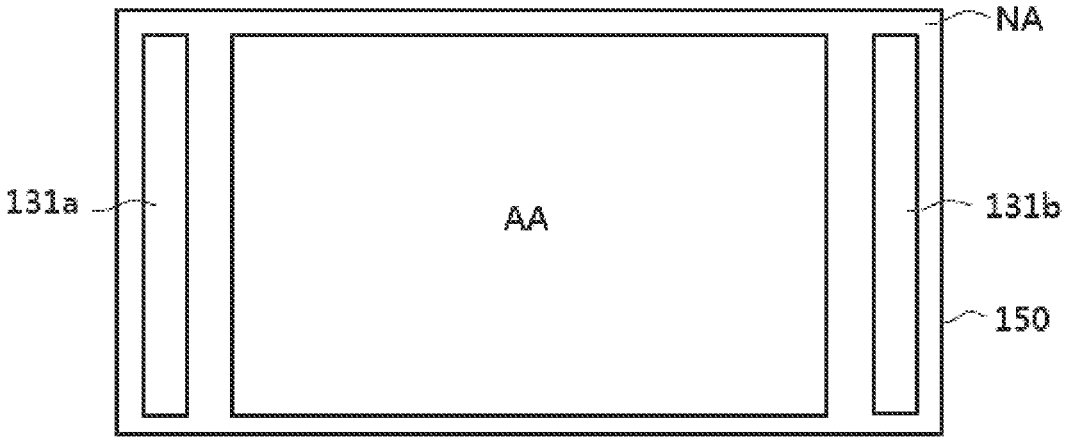
FIG. 4A and FIG. 4B illustrate arrangements of the gate-in-panel scan driver.
Figure 4B:
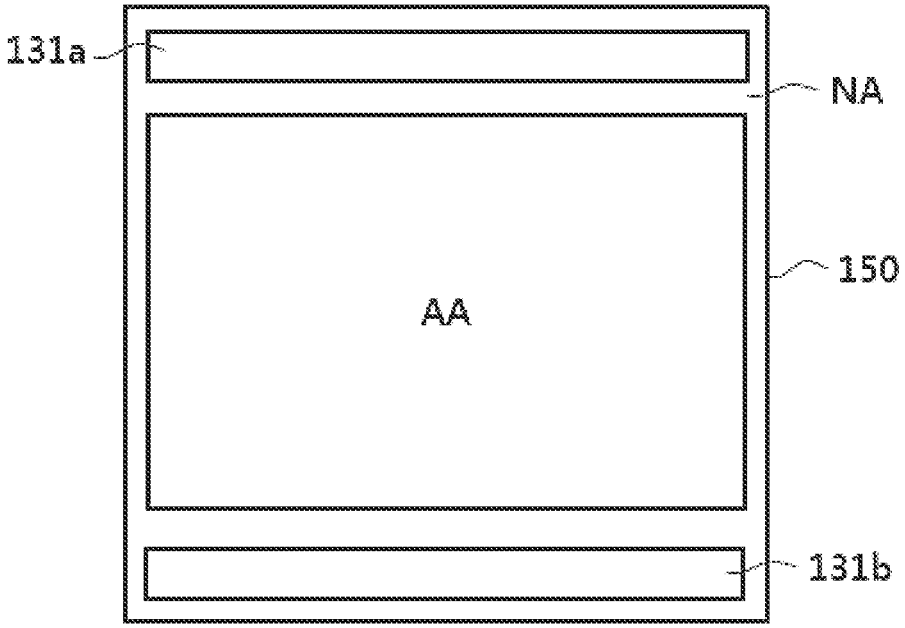

The shift register 131 may be generally arranged in a non-display area NA of the display panel 150. Here, the shift register 131 may be arranged in left and right non-display areas NA of the display panel 150, as shown in FIG. 4A, or may be arranged in upper and lower non-display areas NA of the display panel 150, as shown in FIG. 4B.

Although FIG. 4 illustrates an example in which a first shift register 131*a* and a second shift register 131*b* are arranged in the non-display areas NA on the left and right sides or upper and lower sides of a display area AA, only a single shift register may be arranged in the left, right, upper, or lower non-display area NA. Further, the shift register 131 may be divided and arranged in the non-display area NA and the display area AA or may be arranged in the display area AA in a distributed manner.

In addition, the level shifter 135 may be formed in the form of an independent IC or may be included in the power supply 180 distinguished from the shift register 131. However, this is merely an example, and the display device may be implemented in various forms such as a configuration in which at least one of the timing controller 120, the scan driver 130, and the data driver 140 is integrated in a single IC according to a light emitting display device implementation method.

Figure 5:
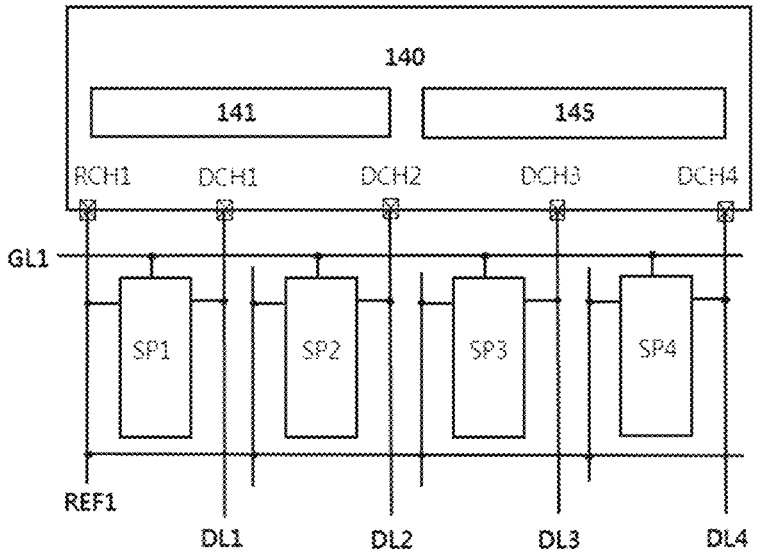
FIG. 5 and FIG. 6 are block diagrams schematically illustrating a data driver according to a first aspect of the present disclosure.
Figure 6:
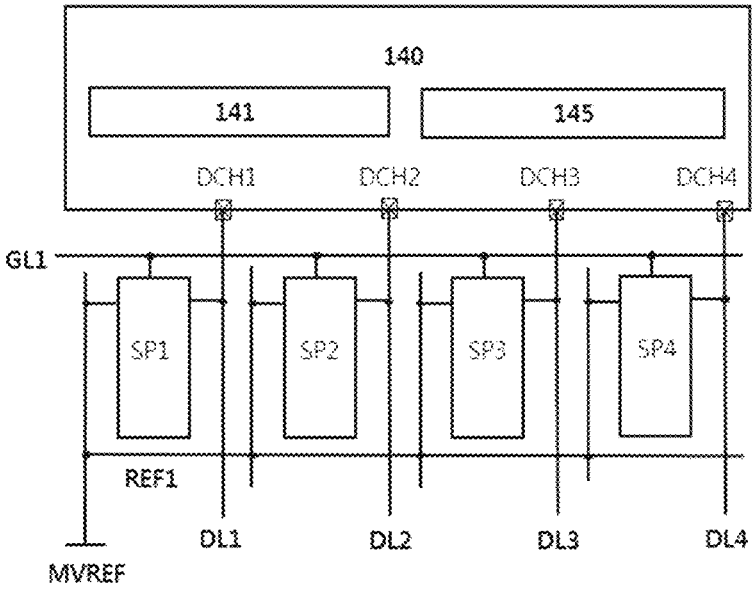

FIG. 5 and FIG. 6 are block diagrams schematically illustrating a data driver according to a first aspect of the present disclosure;

As in a first example illustrated in FIG. 5, the data driver 140 may include data channels DCH1 to DCH4 for supplying a data voltage or an initialization voltage to sub-pixels SP1 to SP4 and sensing voltages, and a reference channel RCH1 for outputting (or transferring) a reference voltage.

The first to fourth data channels DCH1 to DCH4 may be connected to first to fourth data lines DL1 to DL4, respectively. The first to fourth data lines DL1 to DL4 may be connected to the first to fourth sub-pixels SP1 to SP4, respectively. The first reference channel RCH1 may be connected to a first reference line REF1. The first reference line REF1 may be commonly connected to the first to fourth sub-pixels SP1 to SP4.

In the first example of FIG. 5, the first to fourth sub-pixels SP1 to SP4 may share the single reference line REF1 included in the data driver 140. Consequently, the data driver 140 may have a single reference channel RCH1 and four data channels DCH1 to DCH4 for a total of four sub-pixels SP1 to SP4.

As in a second example illustrated in FIG. 6, the data driver 140 may include only the data channels DCH1 to DCH4 for supplying a data voltage or an initialization voltage to the sub-pixels SP1 to SP4 and sensing voltages.

The first to fourth data channels DCH1 to DCH4 may be connected to first to fourth data lines DL1 to DL4, respectively. The first to fourth data lines DL1 to DL4 may be connected to the first to fourth sub-pixels SP1 to SP4, respectively. The first reference channel RCH1 may be connected to a first reference line REF1. The first reference line REF1 may be connected to a common reference voltage line MVREF. The first reference line REF1 may be commonly connected to the first to fourth sub-pixels SP1 to SP4. The common reference voltage line MVREF may be disposed on the display panel in the form of a line on glass (LOG) and may transfer a variable reference voltage.

In the second example of FIG. 6, the first to fourth sub-pixels SP1 to SP4 may share the single reference line REF1 connected to the additionally provided common reference voltage line MVREF. Consequently, the data driver 140 may have four data channels DCH1 to DCH4 for a total of four sub-pixels SP1 to SP4.

As illustrated in FIG. 5 and FIG. 6, the data driver 140 may include a driving circuit 141 that outputs a data voltage for driving the sub-pixels SP1 to SP4 and a compensation circuit 145 that stores and outputs a sensing voltage for sensing the sub-pixels SP1 to SP4 and obtains an integrated sensing voltage.

The compensation circuit 145 may share a single channel with the driving circuit 141. Although the compensation circuit 145 may be separately provided outside the data driver 140, an example in which the compensation circuit 145 is included in the data driver 140 will be described below for convenience of description.

Figure 7:
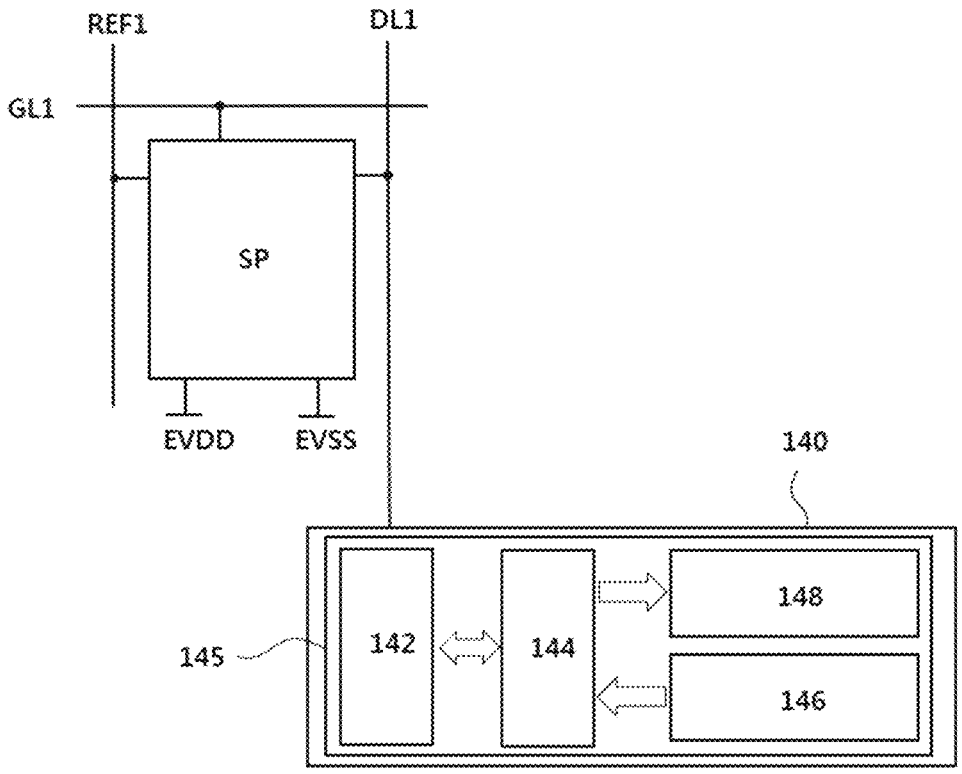
FIG. 7 is a diagram for briefly describing a compensation circuit according to the first aspect of the present disclosure.
Figure 8:
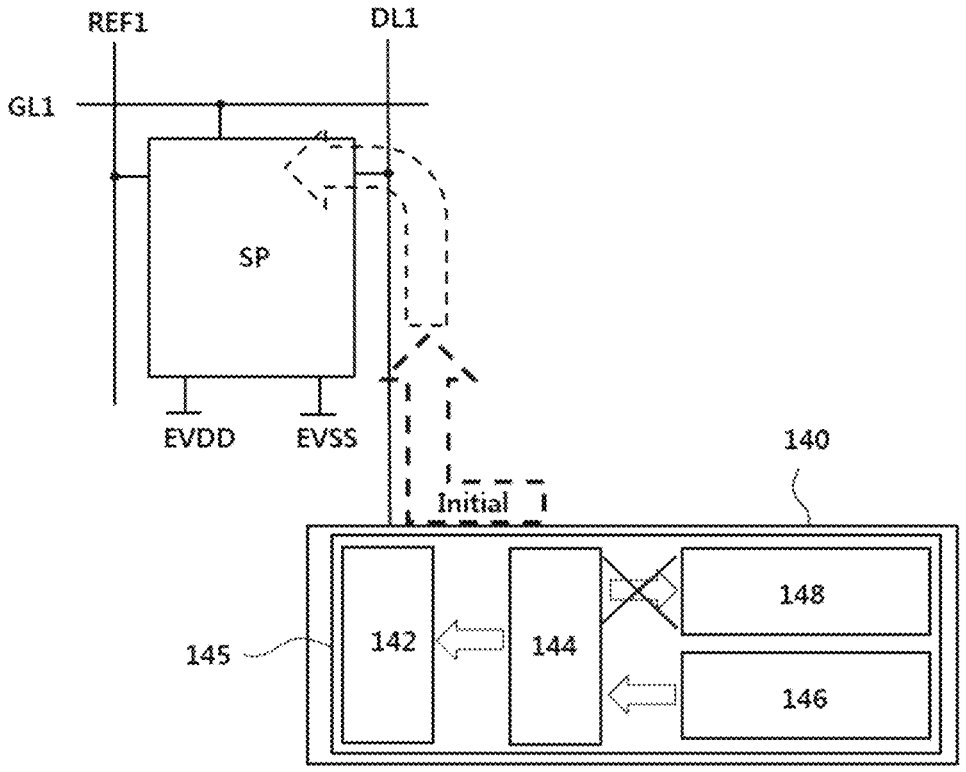
FIG. 8 and FIG. 9 are diagrams for briefly describing a sensing operation of the compensation circuit illustrated in FIG. 7.
Figure 9:
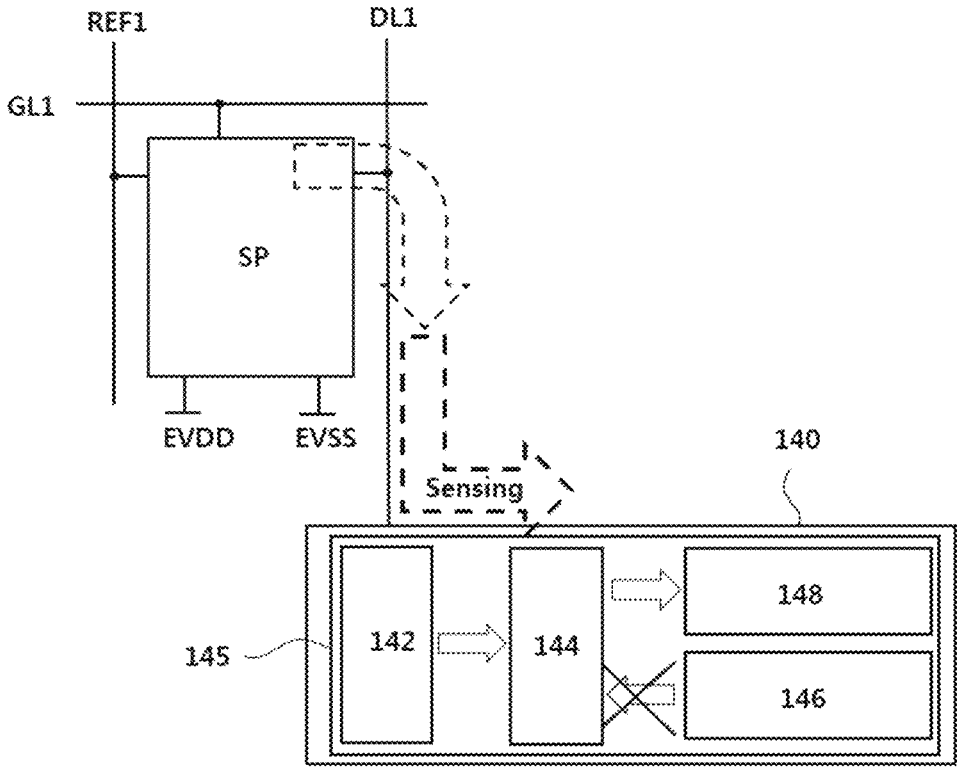

FIG. 7 is a diagram for briefly describing the compensation circuit according to the first aspect of the present disclosure and FIG. 8 and FIG. 9 are diagrams for briefly describing a sensing operation of the compensation circuit illustrated in FIG. 7.

As illustrated in FIG. 7, the compensation circuit 145 included in the data driver 140 may include a switch circuit 142, an output circuit 144, a voltage generator 146, and a sensing circuit 148.

The switch circuit 142 may perform a switching operation for outputting a data voltage or an initialization voltage generated from the voltage generator 146 through the first data line DL1 and a switching operation for repeatedly outputting and sensing a sensing voltage stored in the sensing circuit 148. The output circuit 144 may output the data voltage or the initialization voltage generated from the voltage generator 146 or repeatedly output the sensing voltage stored in the sensing circuit 148. The voltage generator 146 may generate the data voltage or the initialization voltage to be output through the first data line DL1. The sensing circuit 148 may store a sensing voltage sensed through the first data line DL1, integrate the sensing voltage, and detect the integrated sensing voltage.

As illustrated in FIG. 8, the compensation circuit 145 may operate the switch circuit 142, the output circuit 144, and the voltage generator 146 and then apply the initialization voltage Initial to a sub-pixel SP through the first data line DL1.

As illustrated in FIG. 9, the compensation circuit 145 may operate the switch circuit 142, the output circuit 144, and the voltage generator 146 and then obtain a sensing voltage Sensing stored in the sub-pixel SP through the first data line DL1.

In the first aspect of the present disclosure, the components included in the compensation circuit 145 are operated, the initialization voltage Initial is applied to the sub-pixel SP, and the sensing voltage Sensing stored in the sub-pixel SP is obtained. Then, the sensing voltage Sensing is integrated through a repeated sensing method of repeatedly applying the obtained sensing voltage Sensing to the sub-pixel SP and obtaining the sensing voltage, and deterioration of elements included in the sub-pixel SP is compensated based on the integrated sensing voltage.

Hereinafter, the first aspect will be described in more detail using an example in which a single sub-pixel SP includes three N-type transistors, a single capacitor, and a single organic light-emitting diode.

Figure 10:
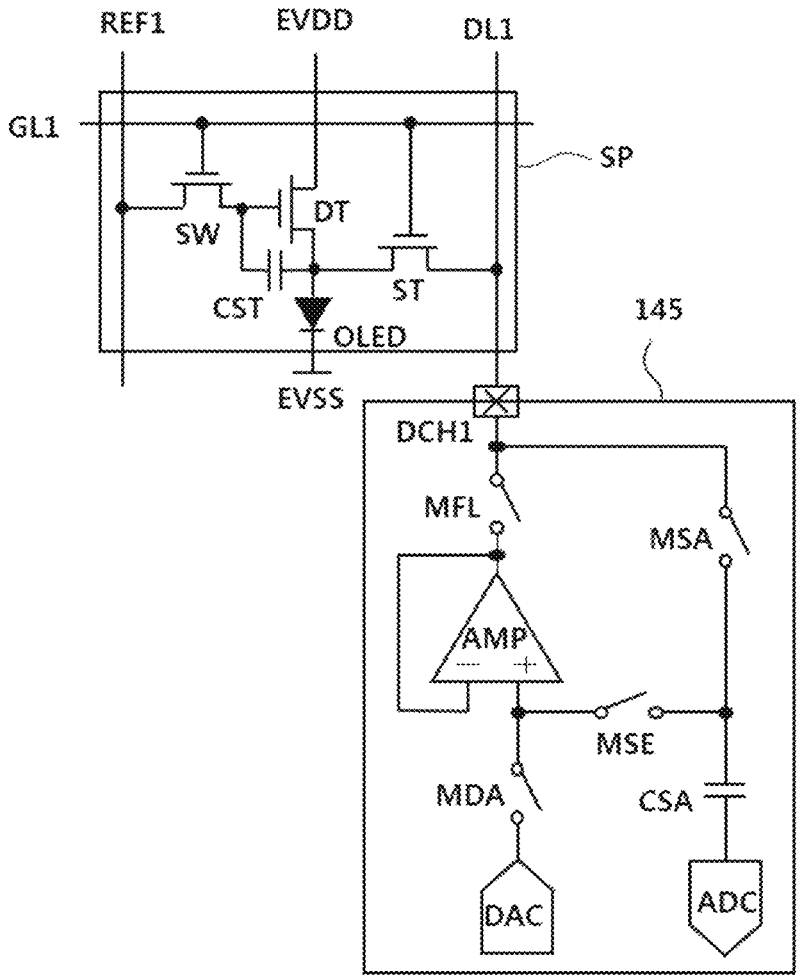
FIG. 10 is a diagram for describing the compensation circuit according to the first aspect of the present disclosure in detail.
Figure 11:
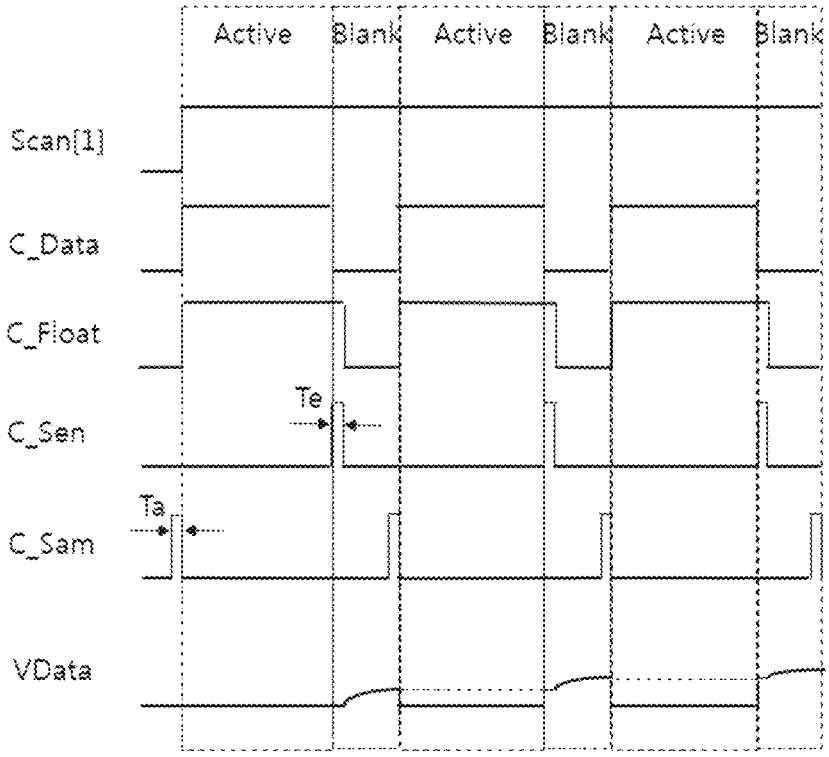
FIG. 11 illustrates driving waveforms for driving the compensation circuit illustrated in FIG. 10.

FIG. 10 is a diagram for describing the compensation circuit according to the first aspect of the present disclosure in detail, FIG. 11 illustrates driving waveforms for driving the compensation circuit illustrated in FIG. 10, and FIG. 12 to FIG. 15 are diagrams for describing the sensing operation of the compensation circuit illustrated in FIG. 10 in detail.

As illustrated in FIG. 10 and FIG. 11, according to the first aspect of the present disclosure, a single sub-pixel SP may include a switching transistor SW, a driving transistor DT, a sensing transistor ST, a capacitor CST, and an organic light-emitting diode OLED.

The driving transistor DT may have a gate electrode connected to a first electrode of the capacitor CST, a first electrode connected to the first power line EVDD, and a second electrode connected to the anode of the organic light emitting diode OLED. The capacitor CST may have the first electrode connected to the gate electrode of the driving transistor DT and a second electrode connected to the anode of the organic light-emitting diode OLED. The anode of the organic light-emitting diode OLED may be connected to the second electrode of the driving transistor DT and the cathode thereof may be connected to the second power line EVSS.

The switching transistor SW may have a gate electrode connected to the first scan line GL1, a first electrode connected to the first reference line REF1, and a second electrode connected to the gate electrode of the driving transistor DT. The sensing transistor ST may have a gate electrode connected to the first scan line GL1, a first electrode connected to the first data line DL1, and a second electrode connected to the anode of the light-emitting diode OLED.

The sensing transistor ST is a kind of compensation circuit added to compensate for deterioration (a threshold voltage of the like) of the driving transistor DT or the organic light-emitting diode OLED. The sensing transistor ST may allow physical threshold voltage sensing based on a source follower operation of the driving transistor DT. The sensing transistor ST may operate to obtain a sensing voltage through a sensing node defined between the driving transistor DR and the organic light-emitting diode OLED. The sensing voltage obtained from the sensing transistor ST may be transferred to the compensation circuit 145 through the first data line DL1.

The compensation circuit 145 may include a first switch MDA, a second switch MFL, a third switch MSA, a fourth switch MSE, an amplification circuit AMP, a first conversion circuit DAC, a sampling circuit CSA, and a second conversion circuit ADC. The first switch MDA, the second switch MFL, the third switch MSA, and the fourth switch MSE may be included in the switch circuit. The amplification circuit may be included in the output circuit. The first conversion circuit DAC may be included in the voltage generator. The sampling circuit CSA and the second conversion circuit ADC may be included in the sensing circuit.

The first switch MDA may have a first electrode connected to an output terminal of the first conversion circuit DAC, a second electrode connected to a non-inverting terminal (+) of the amplification circuit AMP, and a control electrode connected to a first control line. The first switch MDA may be turned on in response to a first control signal C_Data at a logic high level applied through the first control line. When the first switch MDA is turned on, a data voltage or an initialization voltage generated from the first conversion circuit DAC can be applied to the non-inverting terminal (+) of the amplification circuit AMP.

The second switch MFL may have a first electrode connected to the output terminal of the amplification circuit AMP, a second electrode connected to a first data channel DCH1, and a control electrode connected to a second control line. The second switch MFL may be turned on in response to a second control signal C_Float at a logic high level applied through the second control line. When the second switch MFL is turned on, a data voltage, the initialization voltage, or a sensing voltage output from the amplification circuit AMP can be output through the first data channel DCH1.

The third switch MSA may have a first electrode connected to the first data channel DCH1, a second electrode connected to one terminal of the sampling circuit CSA, and a control electrode connected to a third control line. The third switch MSA may be turned on in response to a third control signal C_Sam at a logic high level applied through the third control line. When the third switch MSA is turned on, a sensing voltage obtained from a sub-pixel SP can be transferred to the sampling circuit CSA.

The fourth switch MSE may have a first electrode connected to the non-inverting terminal (+) of the amplification circuit AMP, a second electrode connected to one terminal of the sampling circuit CSA, and a control electrode connected to a fourth control line. The fourth switch MSE may be turned on in response to a fourth control signal C_Sen at a logic high level applied through the fourth control line. When the fourth switch MSE is turned on, a sensing voltage stored in the sampling circuit CSA can be transferred to the non-inverting terminal (+) of the amplification circuit AMP.

An inverting terminal (−) and an output terminal of the amplification circuit AMP may be connected to the first electrode of the second switch MFL and the non-inverting terminal (+) thereof may be connected to the second electrode of the first switch MDA. The amplification circuit AMP may be implemented as an amplifier and may output one of a data voltage and the initialization voltage in response to operation of the first switch MDA or output a sensing voltage in response to operation of the fourth switch MSE.

One terminal (output terminal) of the first conversion circuit DAC may be connected to the first electrode of the first switch MDA. The first conversion circuit DAC may be implemented as a digital-to-analog-converter. Although an example in which the first conversion circuit DAC is included in the compensation circuit 145 is described, the first conversion circuit DAC may be shared with the driving circuit (it may be substituted with a digital-to-analog-converter included in the driving circuit).

One terminal (input/output terminal) of the sampling circuit CSA may be commonly connected to the second electrode of the third switch MSA and the second electrode of the fourth switch MSE. Although the sampling circuit CSA is illustrated as a single capacitor, the present disclosure is not limited thereto. The sampling circuit CSA may store a sensing voltage obtained from the sub-pixel SP or transfer an integrated sensing voltage to the second conversion circuit ADC.

The second conversion circuit ADC may receive the integrated sensing voltage from the sampling circuit CSA and convert the integrated sensing voltage into a digital sensing value. The second conversion circuit ADC may transfer the digital sensing value to the timing controller. The timing controller may perform a compensation operation for compensating for deterioration (for example, shifting the threshold voltage) of the driving transistor (DT) included in the sub-pixel SP based on the digital sensing value transferred from the second conversion circuit ADC.

Figure 12:
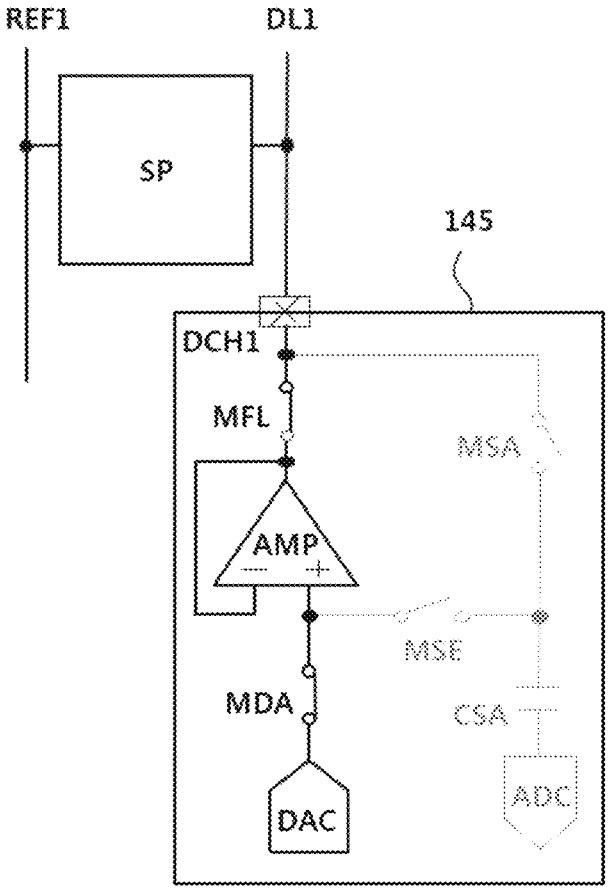
FIG. 12 to FIG. 15 are diagrams for describing a sensing operation of the compensation circuit illustrated in FIG. 10 in detail.

As illustrated in FIG. 11 and FIG. 12, the compensation circuit 145 may perform a driving operation for executing a split sensing operation on a sub-pixel SP that is a deterioration compensation target. To this end, the first conversion circuit DAC may generate and output the initialization voltage and the first switch MDA may be turned on.

The amplification circuit AMP may amplify the initialization voltage and transfer the amplified initialization voltage to the second switch MFL. The second switch MFL may be turned on to output the initialization voltage through the first data channel DCH1. At this time, the third switch MSA and the fourth switch MSE may be turned off and the sampling circuit CSA and the second conversion circuit ADC may not operate.

According to the aforementioned operation, the initialization voltage may be output through the first data channel DCH1 and applied to the sub-pixel SP via the first data line DL1. At this time, the sensing transistor ST in FIG. 10 may be maintained in a turned on state in response to a scan signal Scan[1] at a logic high level such that the initialization voltage is applied to the sub-pixel SP.

Figure 13:
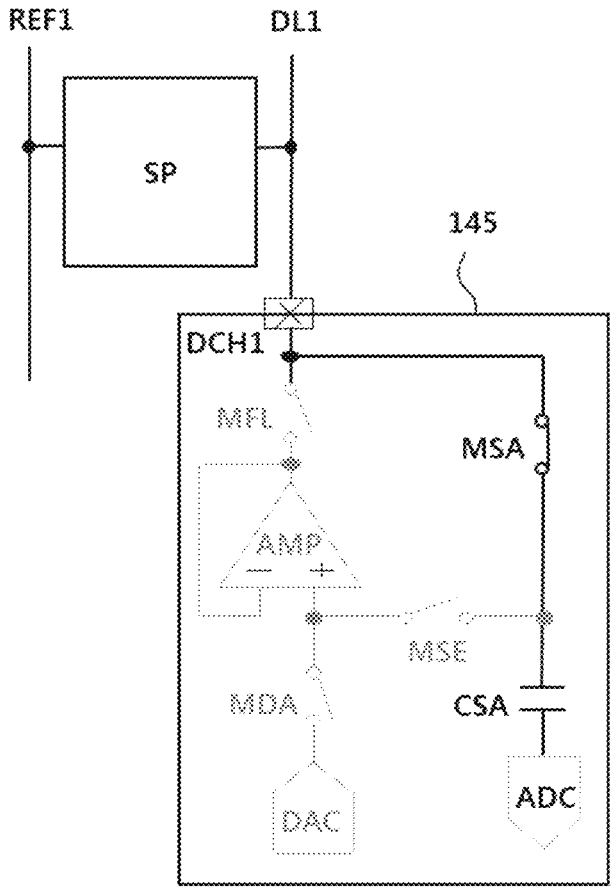

As illustrated in FIG. 11 and FIG. 13, the compensation circuit 145 may perform a sensing operation for obtaining a sensing voltage stored in the sub-pixel SP after applying the initialization voltage. To this end, the third switch MSA may be turned on. At this time, the first switch MDA, the second switch MFL, and the fourth switch MSE may be turned off and the amplification circuit AMP may not operate.

According to the aforementioned operation, the sensing voltage of the sub-pixel SP may be stored in the sampling circuit CSA. The sensing voltage stored in the sampling circuit CSA may be maintained without being transferred to the second conversion circuit ADC until integration is completed.

Figure 14:
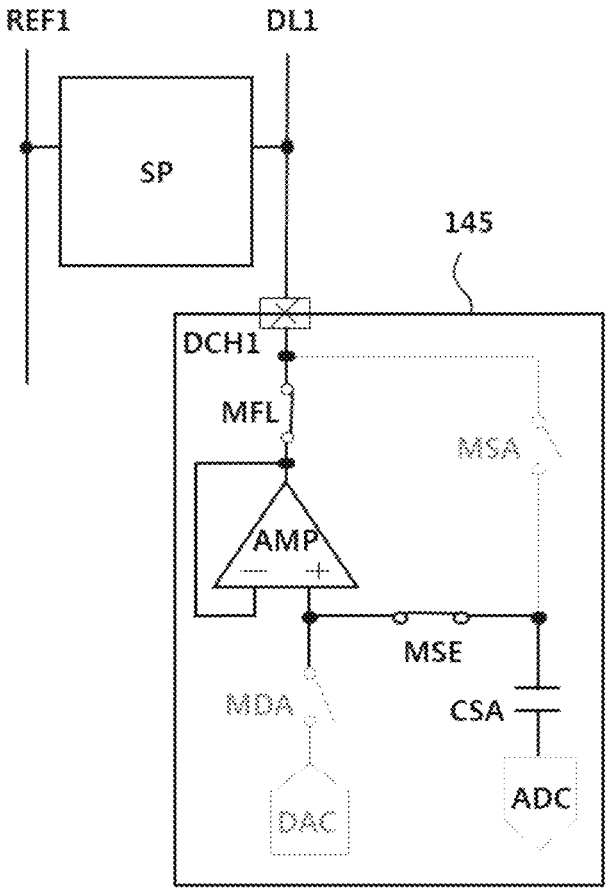

As illustrated in FIG. 11 and FIG. 14, the compensation circuit 145 may perform a driving operation to re-apply the sensing voltage stored in the sampling circuit CSA to the sub-pixel SP. To this end, the fourth switch MSE may be turned on to transfer the sensing voltage stored in the sampling circuit CSA to the non-inverting terminal (+) of the amplification circuit AMP. The amplification circuit AMP may amplify the sensing voltage and transfer the amplified sensing voltage to the second switch MFL. The second switch MFL may be turned to re-output the sensing voltage through the first data channel DCH1.

According to the aforementioned operation, the sensing voltage may be output through the first data channel DCH1 and applied to the sub-pixel SP via the first data line DL1. At this time, the sensing transistor ST in FIG. 10 may be turned on to apply the initialization voltage to the sub-pixel SP.

Figure 15:
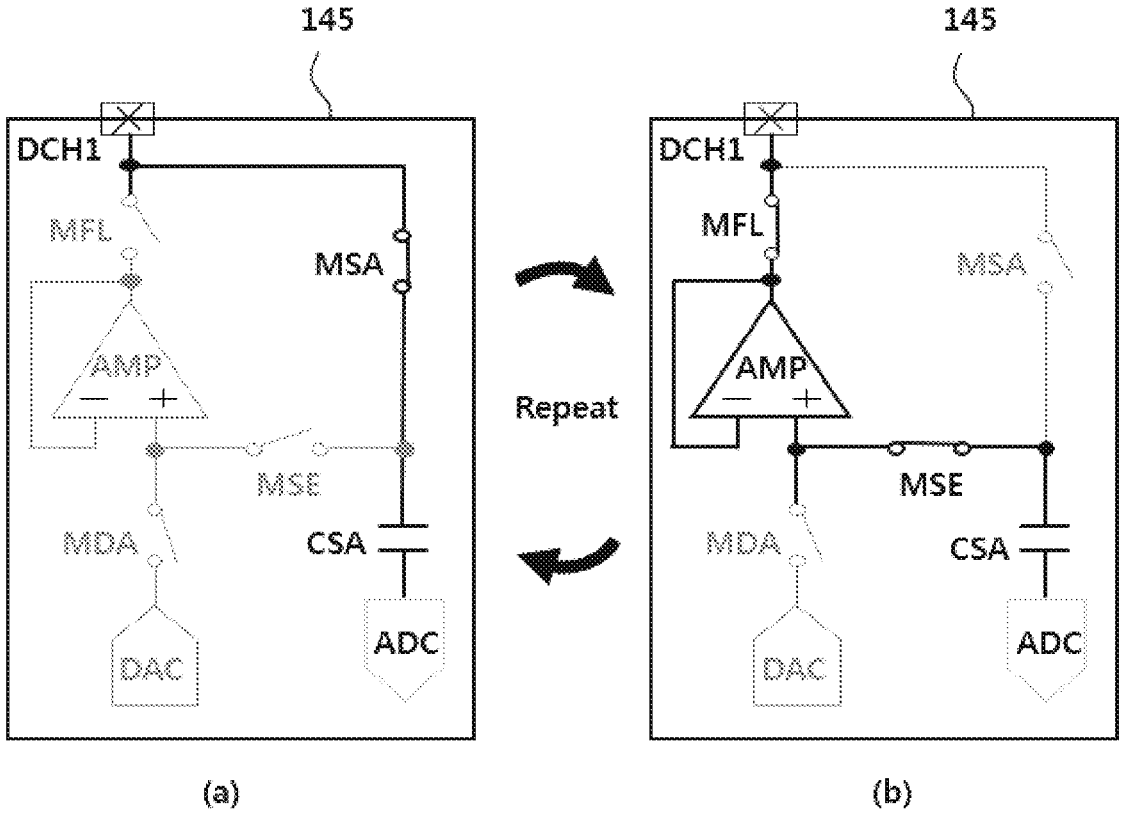

As illustrated in FIG. 11 and FIG. 15, after application of the initialization voltage, a process ((a) of FIG. 15) of storing the sensing voltage in the sampling circuit CSA and a process ((b) of FIG. 15) of re-outputting the sensing voltage stored in the sampling circuit CSA are repeated to integrate the sensing voltage. That is, a process (FIG. 12) of applying the initialization voltage may be omitted.

The above-described operation is performed in a period of compensating a sub-pixel SP that is a deterioration compensation target instead of an image display period and may be repeated for an N-th frame (N being an integer equal to or greater than 1) including an active period Active and a blank period Blank. An active period Active may be defined as a period in which a data voltage for displaying an image is applied, and a blank period Blank may be defined as a period in which a data voltage for displaying an image is not applied or a sub-pixel that is a sensing target is sensed.

Referring to driving waveforms of FIG. 11, although the first control signal C_Data has a logic high level only in active periods Active, the second control signal C_Float may have a logic high level for each active period Active and the initial period of each blank period Blank (starting point of the blank period). The fourth control signal C_Sen may be generated at a logic high level at a point in time at which each blank period Blank starts, and transition of the fourth control signal C_Sen to a logic low level may occur in synchronization with transition of the second control signal C_Float to a logic low level. Here, "Te" that defines a period in which the fourth control signal C_Sen is generated at a logic high level may vary according to driving capability of a circuit that outputs a sensing voltage.

The third control signal C_Sam may be generated at a logic high level for a last period of each blank period Blank (end point of the blank period or before the blank period Blank ends), and transition of the third control signal C_Sen to a logic low level may occur in synchronization with transition of the first control signal C_Data and the second control signal C_Float to a logic high level. Here, "Ta" that defines a period in which the third control signal C_Sam is generated at a logic high level may vary according to driving capability of the circuit that senses a sensing voltage.

Figure 16:
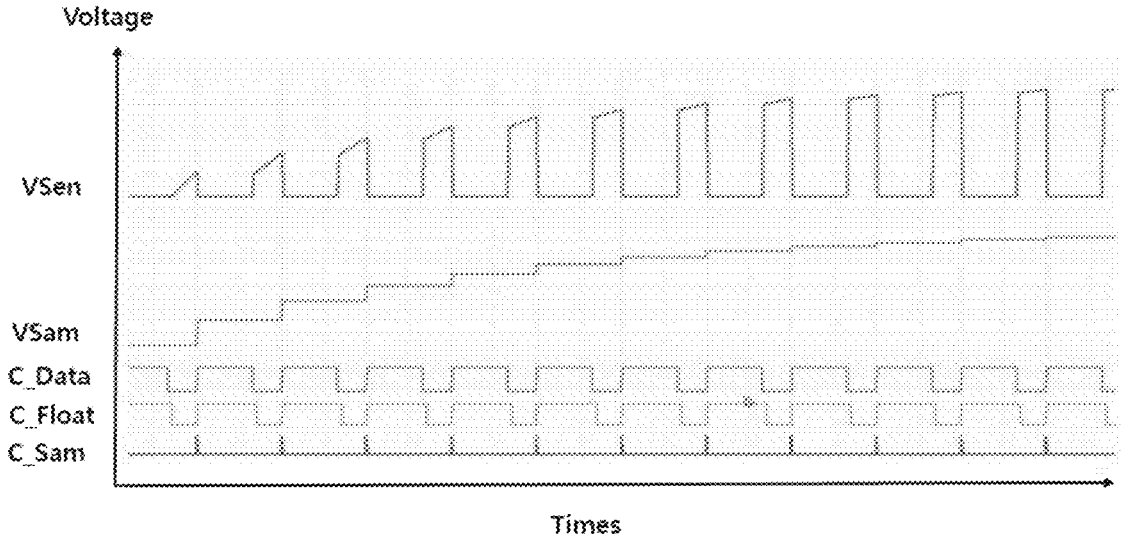
FIG. 16 to FIG. 18 are diagrams for describing simulation results with respect to sensing and compensation operations of a light emitting display device according to the first aspect of the present disclosure and effects according thereto.
Figure 17:
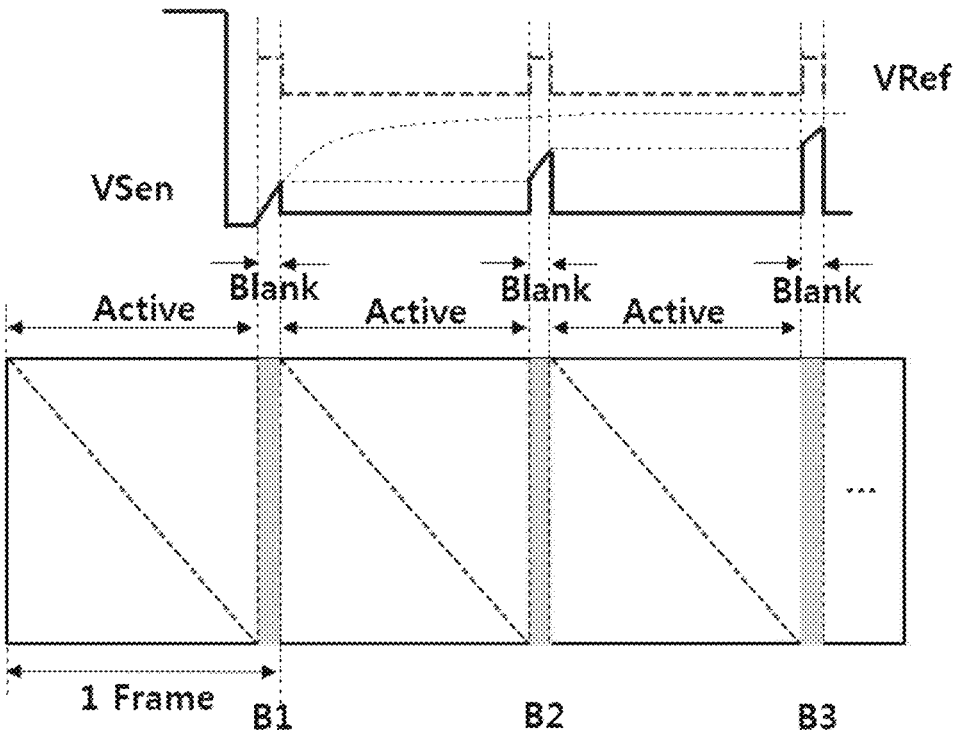
Figure 18:
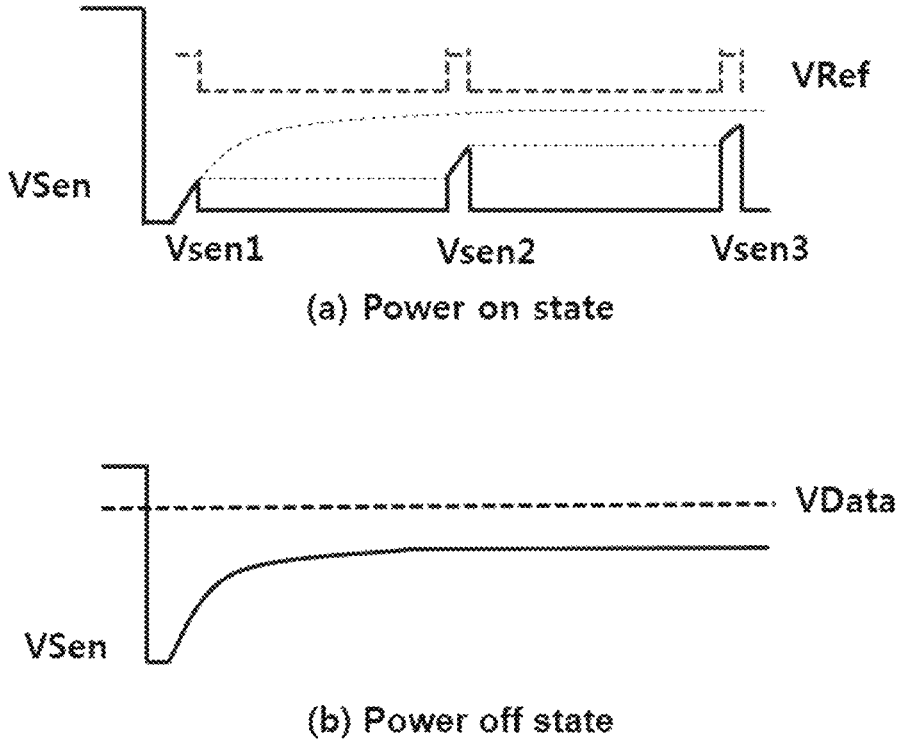

FIG. 16 to FIG. 18 are diagrams for describing simulation results with respect to sensing and compensation operations of a light emitting display device according to the first aspect of the present disclosure and effects according thereto.

As illustrated in FIG. 16, when a sensing operation is repeated for an N-th frame (N being an integer equal to or greater than 1) according to the first aspect of the present disclosure, a pulsed sensing voltage Vsen with a level gradually increasing over time may be applied to sub-pixels. In addition, an integrated sensing voltage VSam with a level gradually increasing over time may be obtained and stored. C_Data, C_Float, and C_Sam represent the first control signal, the second control signal, and the third control signal.

As illustrated in FIG. 10 and FIG. 17, according to the first aspect of the present disclosure, a reference voltage Vref may be maintained at a certain level for an active period Active and changed (increased) to a specific level for a blank period Blank. That is, a sensing voltage at a first level may be obtained in a first blank period B1 and a sensing voltage at a second level or a third level higher than the first level may be obtained in a second blank period B2 or a third blank period B3.

In the light emitting display device according to the first aspect of the present disclosure, a fixed reference voltage VRef may be applied through the first reference line REF1 and a data voltage provided in accordance with grayscale may be applied through the first data line DL1 during data voltage programming for displaying an image. A gate-source voltage of the driving transistor DT may be set by the reference voltage VRef and the data voltage.

According to the first aspect of the present disclosure, the reference voltage Vref may be set to "maximum voltage range—black level margin". The condition of "data voltage<reference voltage" may be applied when an image is displayed, and the condition of "data voltage≥reference voltage" may be applied when black is expressed.

In addition, according to the first aspect of the present disclosure, although a voltage range of 0 to 16 V may be used as in the prior art, the voltage range may be changed to −13 V to 3 V in order to prevent negative effects (high bias) in power consumption and operation of the driving transistor.

As illustrated in FIG. 18, according to the first aspect ((a) of FIG. 18) of the present disclosure, an obtained sensing voltage may be repeatedly output, sensed and integrated as in the first period B1 to the third period B3. For example, a sensing voltage Vsen can be integrated through a repeated sensing method of outputting a first sensing voltage Vsen1, which has been obtained from a first sub-pixel in a first period, to the first sub-pixel in a second period and then sensing the voltage to obtain a second sensing voltage Vsen2.

In general, a sensing operation for detecting a threshold voltage of a driving transistor included in a sub-pixel requires a long sensing time due to the influence of a parasitic capacitor component of a signal line related to sensing. As shown in (b) of FIG. 18, after sensing the threshold voltage of the driving transistor, the threshold voltage may be compensated for a long time after power off.

However, according to the split sensing operation of the first aspect ((a) of FIG. 18) of the present disclosure, a sensing operation can be repeatedly performed for a long time even in a power on state of the light emitting display device. Accordingly, it is possible to improve sensing accuracy and compensation accuracy as compared to a method of performing sensing for a short time and to perform sensing and compensation even in a normal driving state in which the light emitting display device is powered on.

Figure 19:
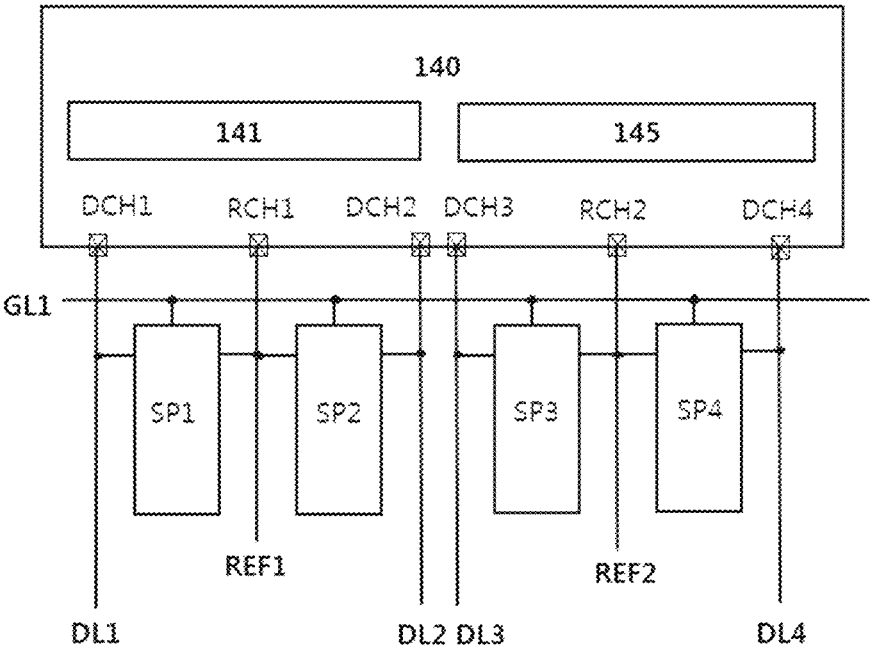
FIG. 19 and FIG. 20 are block diagrams schematically showing a data driver according to a second aspect of the present disclosure.
Figure 20:
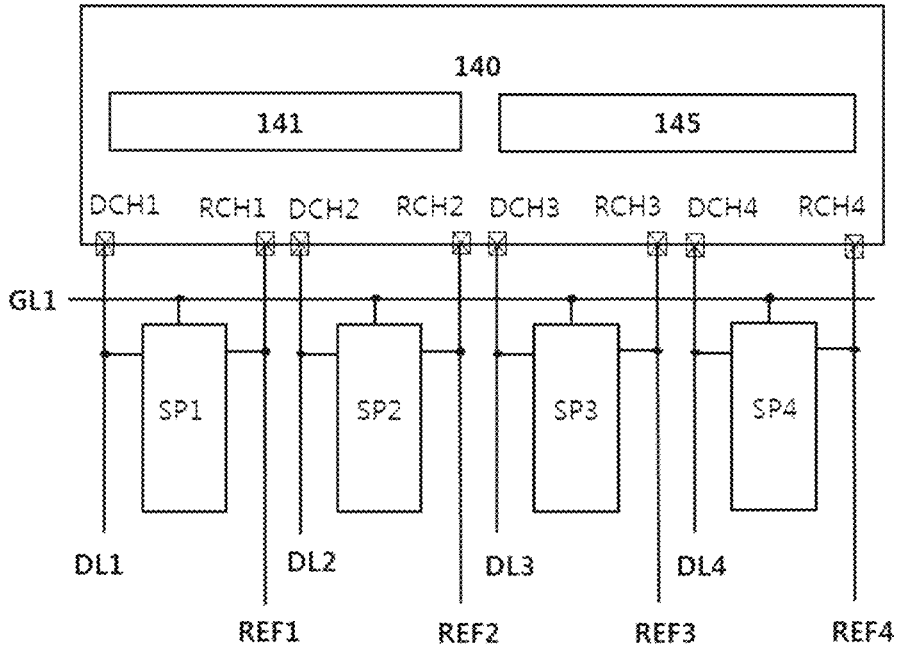

FIG. 19 and FIG. 20 are block diagrams schematically showing a data driver according to a second aspect of the present disclosure.

In a third example illustrated in FIG. 19, a data driver 140 may include data channels DCH1 to DCH4 for supplying a data voltage to sub-pixels SP1 to SP4 and reference channels RCH1 and RCH2 for outputting (or transferring) and sensing a reference voltage or an initialization voltage.

The first to fourth data channels DCH1 to DCH4 may be connected to first to fourth data lines DL1 to DL4, respectively. The first to fourth data lines DL1 to DL4 may be connected to the first to fourth sub-pixels SP1 to SP4, respectively. The first reference channel RCH1 may be connected to a first reference line REF1. The first reference line REF1 may be commonly connected to the laterally neighboring first and second sub-pixels SP1 and SP2. The second reference channel RCH2 may be connected to a second reference line REF2. The second reference line REF2 may be commonly connected to the laterally neighboring third and fourth sub-pixels SP3 and SP4.

In the third example of FIG. 19, the first and second sub-pixels SP1 and SP2 may share the first reference line REF1 included in the data driver 140 and the third and fourth sub-pixels SP3 and SP4 may share the second reference line REF2 included in the data driver 140. Consequently, the data driver 140 may have two reference channels RCH1 and RCH2 and four data channels DCH1 to DCH4 for a total of four sub-pixels SP1 to SP4.

As in a fourth example illustrated in FIG. 20, the data driver 140 may include data channels DCH1 to DCH4 for supplying a data voltage to the sub-pixels SP1 to SP4 and reference channels RCH1 to RCH4 for outputting (or transferring) and sensing a reference voltage or an initialization voltage.

The first to fourth data channels DCH1 to DCH4 may be connected to first to fourth data lines DL1 to DL4, respectively. The first to fourth data lines DL1 to DL4 may be connected to the first to fourth sub-pixels SP1 to SP4, respectively. The first to fourth reference channels RCH1 to RCH4 may be connected to first to fourth reference lines REF1 to REF4, respectively. The first to fourth reference lines REF1 to REF4 may be connected to the first to fourth sub-pixels SP1 to SP4, respectively.

In the fourth example of FIG. 20, the first to fourth sub-pixels SP1 to SP4 may be connected to the first to fourth data lines DL1 to DL4 and the first to fourth reference lines REF1 to REF4, respectively. That is, the first to fourth sub-pixels SP1 to SP4 may have independent data lines and reference lines. Consequently, the data driver 140 may have four reference channels RCH1 to RCH4 and four data channels DCH1 to DCH4 for a total of four sub-pixels SP1 to SP4.

As illustrated in FIG. 19 and FIG. 20, the data driver 140 may include a driving circuit 141 that outputs a data voltage for driving the sub-pixels SP1 to SP4 and a compensation circuit 145 that stores and outputs a sensing voltage for sensing the sub-pixels SP1 to SP4 and obtains an integrated sensing voltage.

The compensation circuit 145 may have a dedicated channel without sharing a channel with the driving circuit 141. Although the compensation circuit 145 may be separately provided outside the data driver 140, an example in which the compensation circuit 145 is included in the data driver 140 will be described below for convenience of description.

Figure 21:
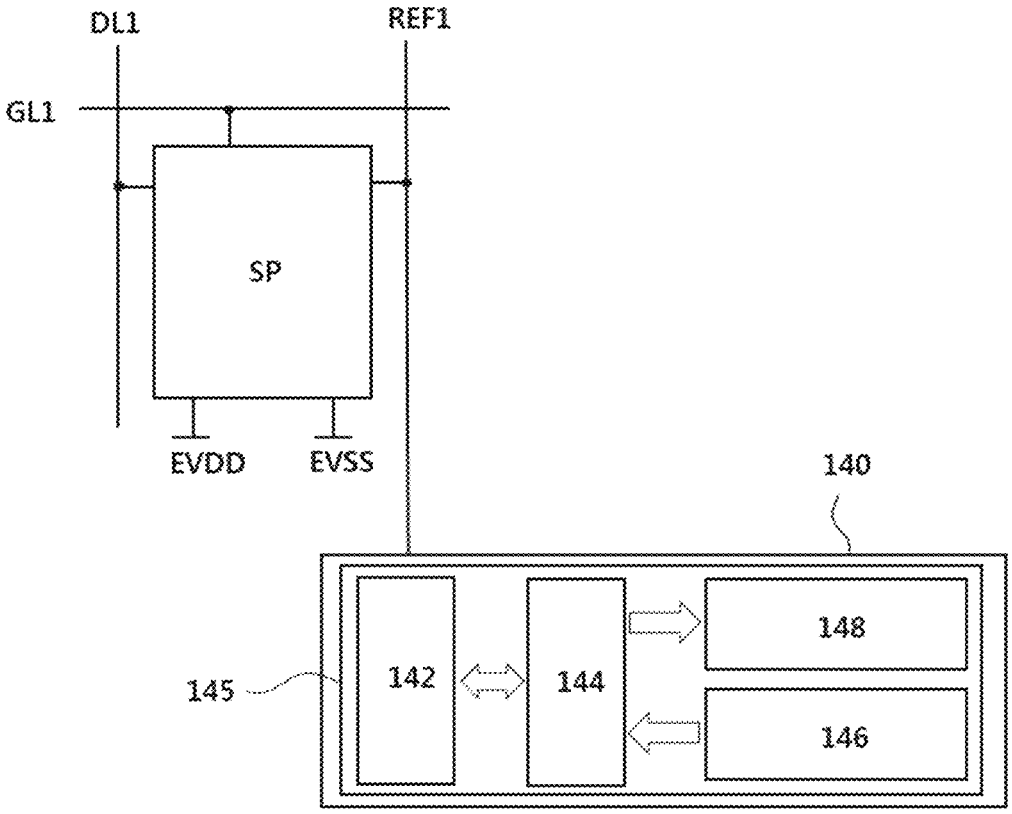
FIG. 21 is a diagram for briefly describing a compensation circuit according to the second aspect of the present disclosure.

FIG. 21 is a diagram for briefly describing the compensation circuit according to the second aspect of the present disclosure.

As illustrated in FIG. 21, the compensation circuit 145 included in the data driver 140 may include a switch circuit 142, an output circuit 144, a voltage generator 146, and a sensing circuit 148.

The compensation circuit 145 according to the second aspect of the present disclosure has components similar to those of the first aspect and thus may perform a switching operation for outputting a data voltage or an initialization voltage generated from the voltage generator 146 and a switching operation for repeatedly outputting and sensing a sensing voltage stored in the sensing circuit 148.

Hereinafter, the second aspect will be described in detail using an example in which a single sub-pixel SP includes three transistors, a single capacitor, and a single organic light-emitting diode.

Figure 22:
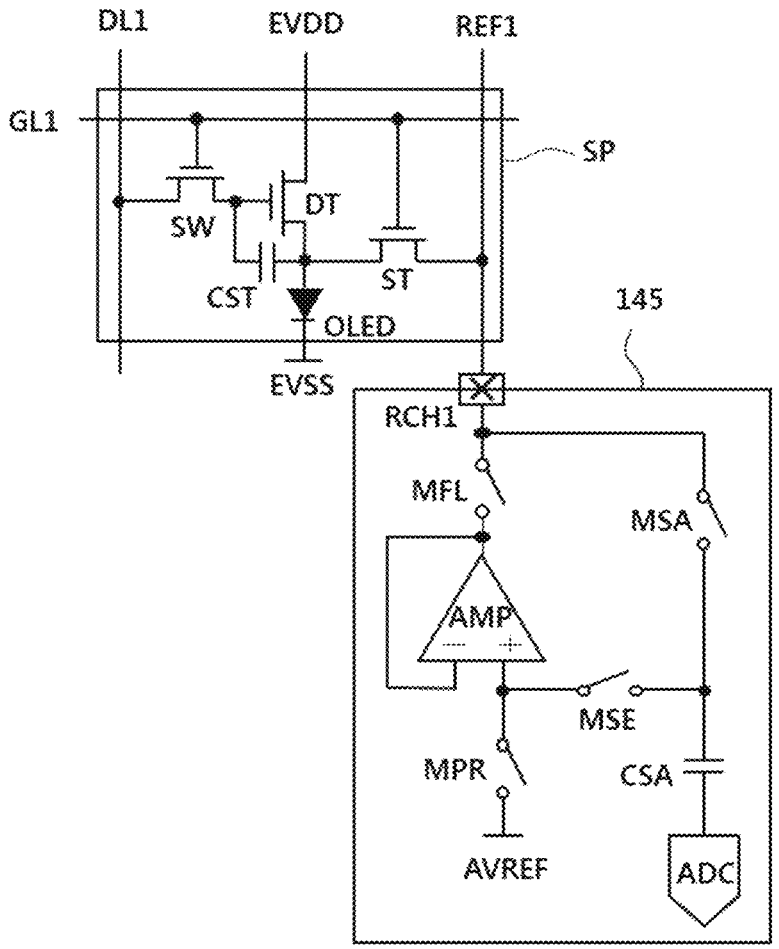
FIG. 22 is a diagram for describing the compensation circuit according to the second aspect of the present disclosure in detail.
Figure 23:
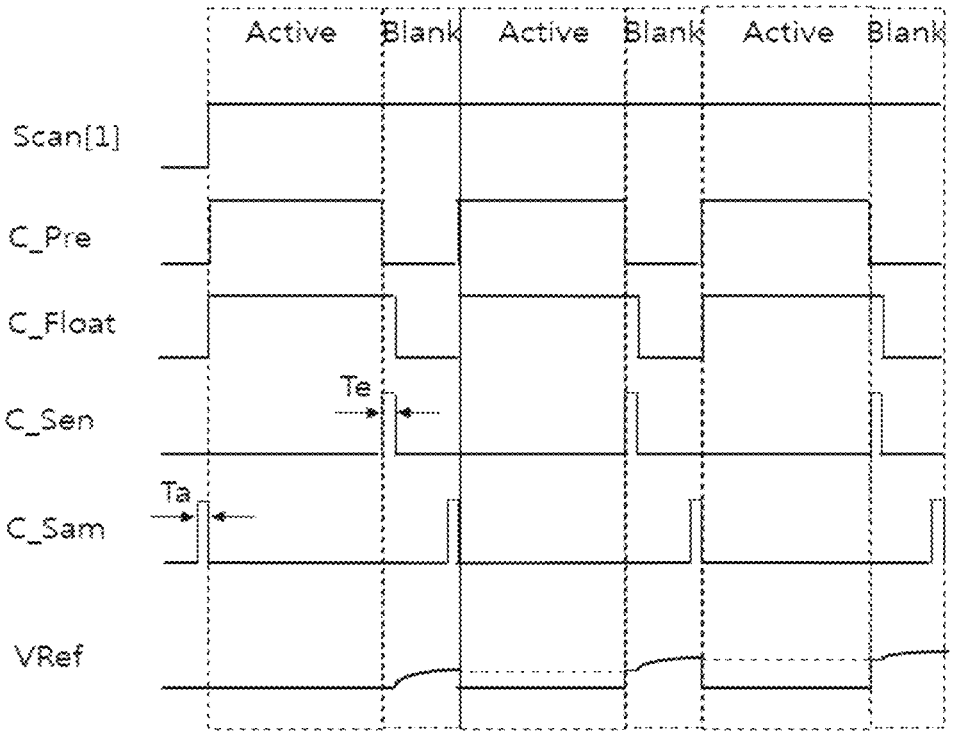
FIG. 23 illustrates driving waveforms for driving the compensation circuit illustrated in FIG. 22.
Figure 24:
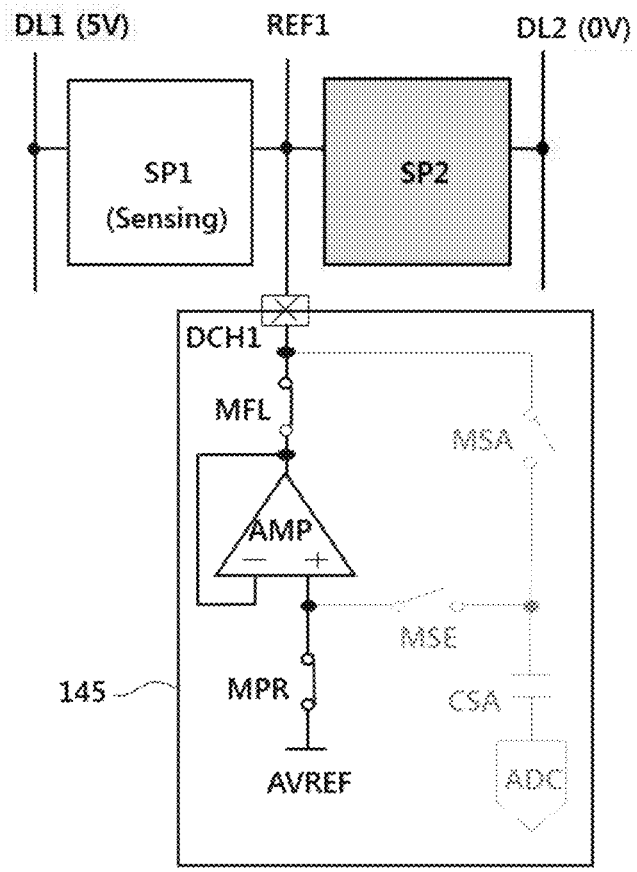
FIG. 24 to FIG. 27 are diagrams for describing a sensing operation of the compensation circuit illustrated in FIG. 22.
Figure 25:
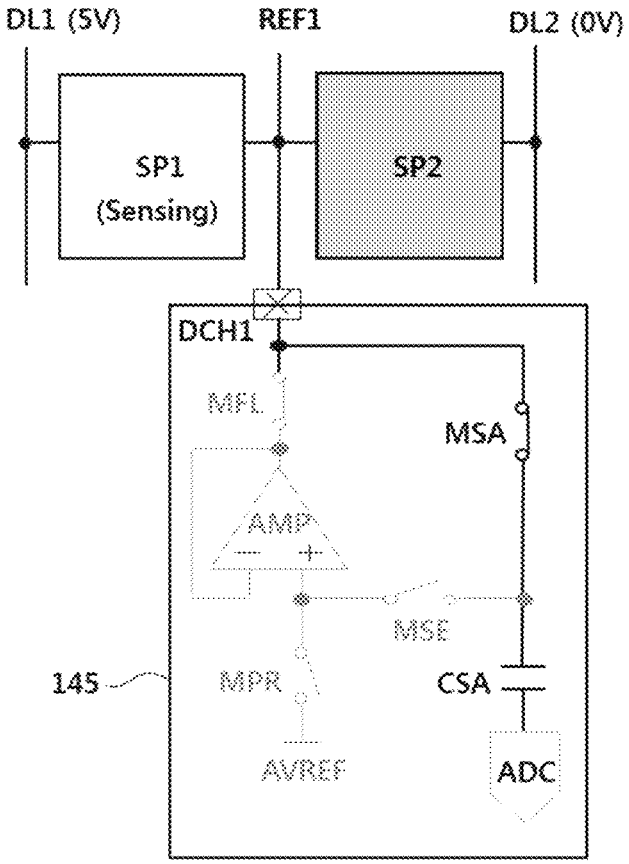
Figure 26:
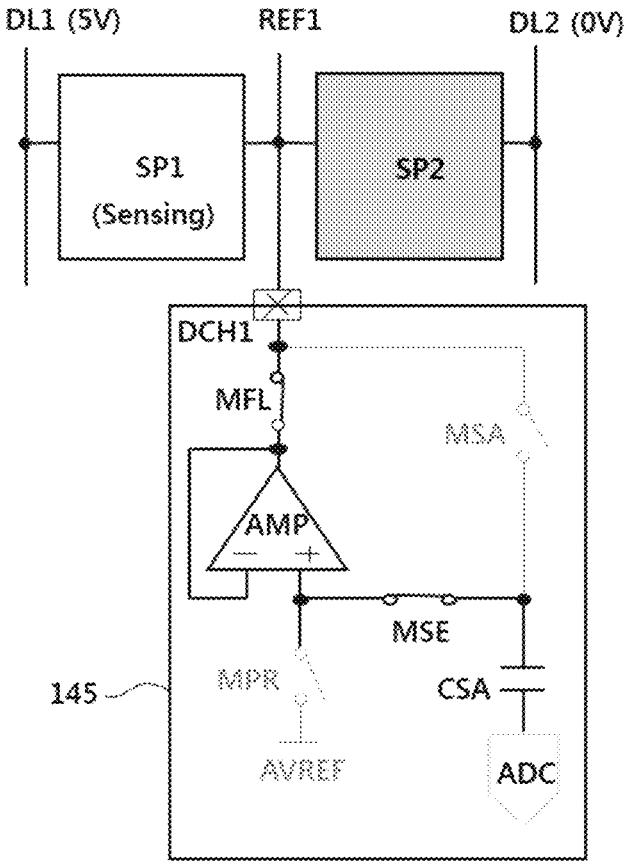

FIG. 22 is a diagram for describing the compensation circuit according to the second aspect of the present disclosure in detail, FIG. 23 illustrates driving waveforms for driving the compensation circuit illustrated in FIG. 22, and FIG. 24 to FIG. 27 are diagrams for describing the sensing operation of the compensation circuit illustrated in FIG. 22 in detail.

As illustrated in FIG. 22 and FIG. 23, according to the second aspect of the present disclosure, a single sub-pixel SP may include a switching transistor SW, a driving transistor DT, a sensing transistor ST, a capacitor CST, and an organic light-emitting diode OLED.

The driving transistor DT may have a gate electrode connected to a first electrode of the capacitor CST, a first electrode connected to the first power line EVDD, and a second electrode connected to the anode of the organic light emitting diode OLED. The capacitor CST may have the first electrode connected to the gate electrode of the driving transistor DT and a second electrode connected to the anode of the organic light-emitting diode OLED. The anode of the organic light-emitting diode OLED may be connected to the second electrode of the driving transistor DT and the cathode thereof may be connected to the second power line EVSS.

The switching transistor SW may have a gate electrode connected to the first scan line GL1, a first electrode connected to the first reference line REF1, and a second electrode connected to the gate electrode of the driving transistor DT. The sensing transistor ST may have a gate electrode connected to the first scan line GL1, a first electrode connected to the first reference line REF1, and a second electrode connected to the anode of the light-emitting diode OLED.

The sensing transistor ST is a kind of compensation circuit added to compensate for deterioration or threshold voltages of the driving transistor DT and the organic light-emitting diode OLED. The sensing transistor ST may operate to obtain a sensing voltage through a sensing node defined between the driving transistor DR and the organic light-emitting diode OLED. The sensing voltage obtained from the sensing transistor ST may be transferred to the compensation circuit 145 through the first reference line REF1.

The compensation circuit 145 may include a first switch MPR, a second switch MFL, a third switch MSA, a fourth switch MSE, an amplification circuit AMP, a variable voltage source AVREF, a sampling circuit CSA, and a second conversion circuit ADC. The first switch MPR, the second switch MFL, the third switch MSA, and the fourth switch MSE may be included in the switch circuit. The amplification circuit may be included in the output circuit. The variable voltage source AVREF may be included in the voltage generator. The sampling circuit CSA and the second conversion circuit ADC may be included in the sensing circuit.

The first switch MPR may have a first electrode connected to the variable voltage source AVREF, a second electrode connected to a non-inverting terminal (+) of the amplification circuit AMP, and a control electrode connected to a first control line. The first switch MPR may be turned on in response to a first control signal C_Pre at a logic high level applied through the first control line. When the first switch MPR is turned on, an initialization voltage generated from the variable voltage source AVREF can be applied to the non-inverting terminal (+) of the amplification circuit AMP.

The second switch MFL may have a first electrode connected to an output terminal of the amplification circuit AMP, a second electrode connected to a first reference channel RCH1, and a control electrode connected to a second control line. The second switch MFL may be turned on in response to a second control signal C_Float at a logic high level applied through the second control line. When the second switch MFL is turned on, a data voltage or the initialization voltage output from the amplification circuit AMP can be output through the first reference channel RCH1.

The third switch MSA may have a first electrode connected to the first reference channel RCH1, a second electrode connected to one terminal of the sampling circuit CSA, and a control electrode connected to a third control line. The third switch MSA may be turned on in response to a third control signal C_Sam at a logic high level applied through the third control line. When the third switch MSA is turned on, a sensing voltage obtained from a sub-pixel SP can be transferred to the sampling circuit CSA.

The fourth switch MSE may have a first electrode connected to the non-inverting terminal (+) of the amplification circuit AMP, a second electrode connected to one terminal of the sampling circuit CSA, and a control electrode connected to a fourth control line. The fourth switch MSE may be turned on in response to a fourth control signal C_Sen at a logic high level applied through the fourth control line. When the fourth switch MSE is turned on, a sensing voltage stored in the sampling circuit CSA can be transferred to the non-inverting terminal (+) of the amplification circuit AMP.

An inverting terminal (−) and an output terminal of the amplification circuit AMP may be connected to the first electrode of the second switch MFL and the non-inverting terminal (+) thereof may be connected to the second electrode of the first switch MPR. The amplification circuit AMP may be implemented as an amplifier and may output the initialization voltage in response to operation of the first switch MPR or output a sensing voltage in response to operation of the fourth switch MSE.

One terminal (input/output terminal) of the sampling circuit CSA may be commonly connected to the second electrode of the third switch MSA and the second electrode of the fourth switch MSE. Although the sampling circuit CSA is illustrated as a single capacitor, the present disclosure is not limited thereto. The sampling circuit CSA may store a sensing voltage obtained from the sub-pixel SP or transfer an integrated sensing voltage to the second conversion circuit ADC.

The second conversion circuit ADC may receive the integrated sensing voltage from the sampling circuit CSA and convert the integrated sensing voltage into a digital sensing value. The second conversion circuit ADC may transfer the digital sensing value to the timing controller. The timing controller may perform a compensation operation for compensating for deterioration (for shifting the threshold voltage) of the driving transistor (DT) included in the sub-pixel SP based on the digital sensing value transferred from the second conversion circuit ADC.

As illustrated in FIG. 24 to FIG. 27, the second aspect of the present disclosure can apply the initialization voltage to the sub-pixels, obtain a sensing voltage from the sub-pixel SP, and re-apply the sensing voltage to the sub-pixel SP as in the first aspect.

However, the laterally neighboring first and second sub-pixels SP1 and SP2 share the first reference line REF1 in the second aspect. Differences from the first aspect will be described on the basis of conditions for sensing the first sub-pixel SP1.

To sense the first sub-pixel SP1 and not to sense the second sub-pixel SP2, a voltage for sensing may be applied to the first data line DL1 and a voltage for not-sensing may be applied to the second data line DL2. The voltage for sensing and the voltage for not-sensing may be output from the driving circuit, the voltage for sensing may be 5 V, for example, and the voltage for not-sensing may be 0 V, for example. However, the present disclosure is not limited thereto.

Figure 27:
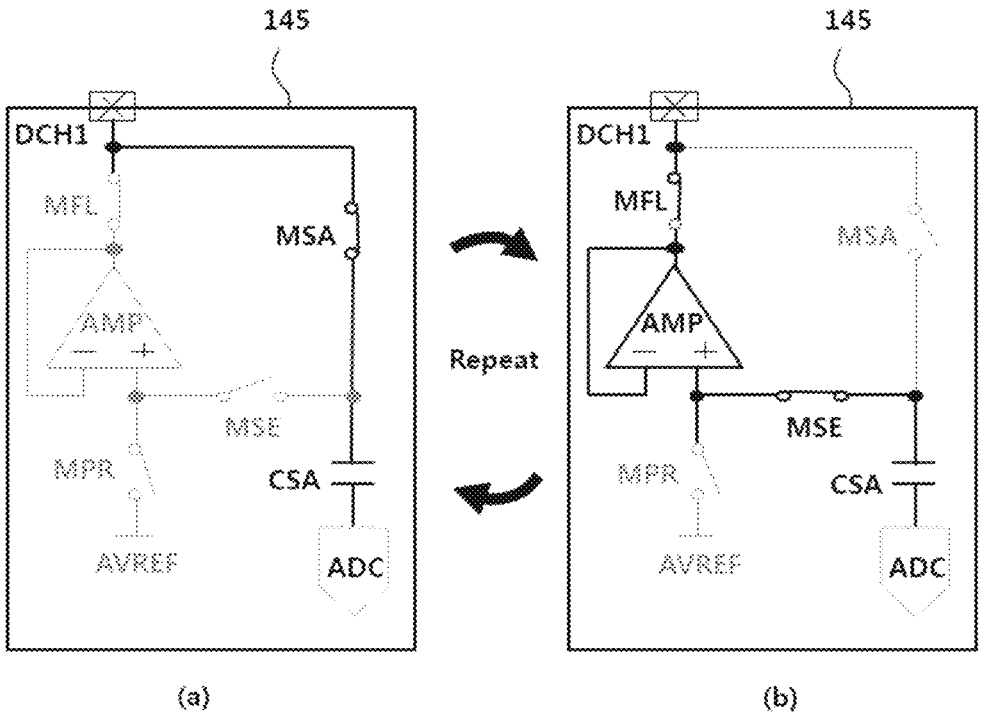

As illustrated in FIG. 23 and FIG. 27, after application of the initialization voltage, a process ((a) of FIG. 27) of storing the sensing voltage in the sampling circuit CSA and a process ((b) of FIG. 27) of re-outputting the sensing voltage stored in the sampling circuit CSA may be repeated to integrate the sensing voltage. That is, a process (FIG. 24) of applying the initialization voltage may be omitted.

The aforementioned operation is performed in a period of compensating a sub-pixel SP that is a deterioration compensation target instead of an image display period and may be repeated for an N-th frame (N being an integer equal to or greater than 1) including an active period Active and a blank period Blank.

Figure 28:
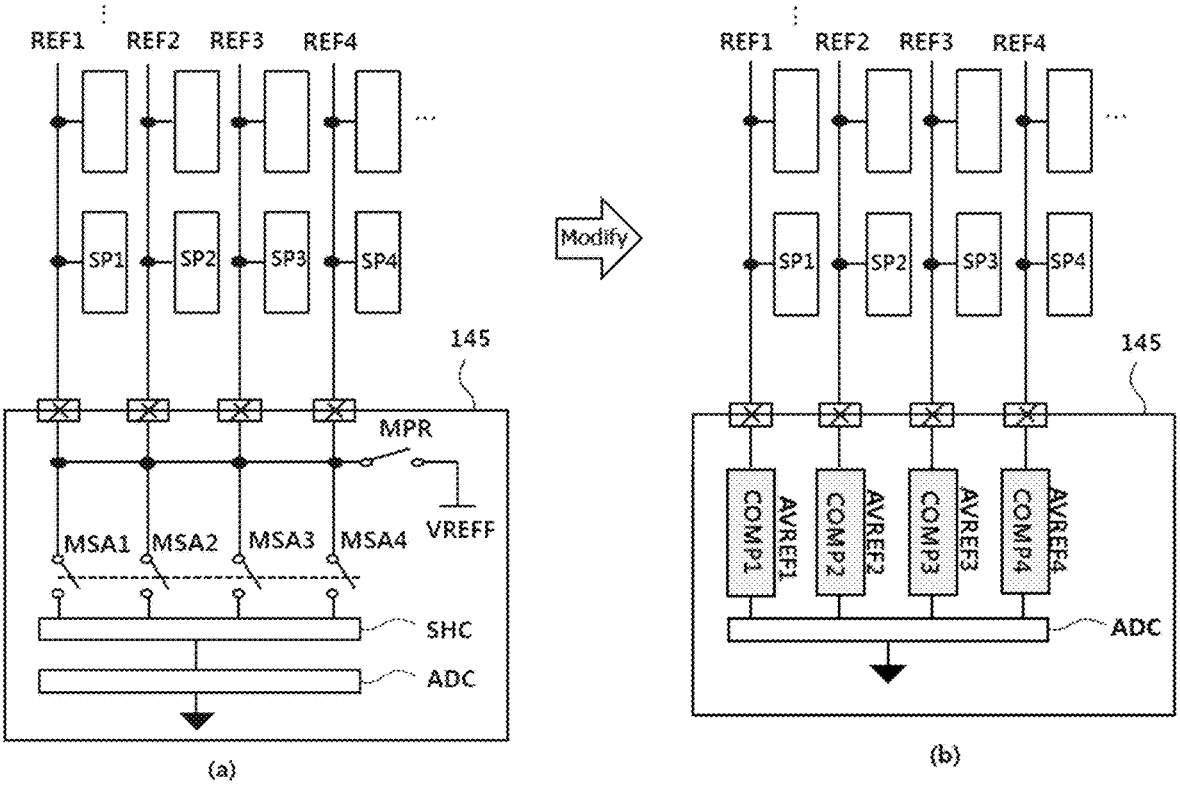
FIG. 28 is a diagram for describing the effects according to a device configuration of the compensation circuit according to the second aspect of the present disclosure.

FIG. 28 is a diagram for describing the effects according to a device configuration of the compensation circuit according to the second aspect of the present disclosure.

As illustrated in (a) of FIG. 28, according to the present disclosure, an additional voltage source VREFF and a switch MPR may be configured in the compensation circuit 145 in order to commonly apply a reference voltage or an initialization voltage to the first to the fourth reference lines REF1 to REF4. MSA1 to MSA4 represent switches operating to obtain sensing voltages of the sub-pixels SP1 to SP4, SHC represents a sampling circuit for sampling a sensing voltage, and ADC represents a conversion circuit for converting the sampled sensing voltage into a digital sensing value. However, according to this configuration, it is difficult to individually provide reference voltages or initialization voltages necessary for respective sub-pixels.

According to the second aspect of the present disclosure, individual compensation circuits COMP1 to COMP4 having individual variable voltage sources AVREF1 to AVREF4 may be configured, as illustrated in (b) of FIG. 28. Each of the individual compensation circuits COMP1 to COMP4 may be implemented as the circuit described in FIG. 22. Consequently, it is possible to individually provide reference voltages or initialization voltages to be applied to the first to fourth reference lines REF1 to REF4 and apply the voltages to the first to fourth reference lines REF1 to REF4. Accordingly, the second aspect can individually provide and apply a reference voltage or an initialization voltage necessary for each sub-pixel to improve sensing accuracy and compensation accuracy.

As described above, the present disclosure can sense information about deterioration of an element included in a sub-pixel and compensate for the deterioration through a real-time split sensing method at the time of driving a light emitting display device. In addition, the present disclosure can improve sensing accuracy and compensation accuracy through a repeated and continuous split sensing operation at the time of driving a light emitting display device. Furthermore, the present disclosure can simplify a configuration of a circuit capable of performing real-time split sensing based on a method of storing a sensing voltage obtained from an element included in a sub-pixel in a data driver and re-outputting the sensing voltage. The present disclosure can perform a split sensing operation not only in a turn-on state in which an image is displayed on a display panel (while the light emitting display device operates) but only in a turn-off state in which an image is not displayed on the display panel (while the light emitting display device does not operate), and compensate for deterioration based thereon.

What is claimed is:

1. A light emitting display device, comprising:
a display panel configured to display an image;
a driver configured to drive the display panel; and
a compensation circuit configured to
obtain a first sensing voltage of a first frame from a sub-pixel included in the display panel,
store the first sensing voltage,
output a second voltage to the sub-pixel, and
obtain the first sensing voltage of a second frame from the sub-pixel and integrate the first sensing voltage of the first frame and the first sensing voltage of the second frame to generate the second voltage.

2. The light emitting display device of claim 1, wherein the compensation circuit is configured to apply the second voltage to the sub-pixel, obtain the first sensing voltage from the sub-pixel during the second frame, and output the second voltage in every blank period of the display panel.

3. The light emitting display device of claim2, wherein the compensation circuit configured to obtain the first sensing voltage from the sub-pixel during a first blank period of the display panel, output the second voltage to the sub-pixel during a second blank period of the display panel, and sense the first sensing voltage during the second frame to obtain second voltage, wherein the second voltage is higher than the first sensing voltage.

4. The light emitting display device of claim 1, wherein the compensation circuit includes:
a switch circuit configured to perform a switching operation for outputting the second voltage to the sub-pixel and a switching operation for repeatedly outputting and sensing the first sensing voltage;

an output circuit configured to amplify and output the second voltage or to amplify and output the first sensing voltage; and a sensing circuit configured to store and integrate the first sensing voltage.

5. The light emitting display device of claim 1, wherein the compensation circuit comprises:

a first switch having a first electrode connected to a terminal through which the second voltage is output, a second electrode connected to a non-inverting terminal of an amplification circuit configured to amplify and output the second voltage, and a control electrode connected to a first control line;

a second switch having a first electrode connected to an output terminal of the amplification circuit, a second electrode connected to an output channel, and a control electrode connected to a second control line;

a third switch having a first electrode connected to the output channel, a second electrode connected to one terminal of a sampling circuit configured to store the first sensing voltage, and a control electrode connected to a third control line; and a fourth switch having a first electrode connected to the non-inverting terminal of the amplification circuit, a second electrode connected to one terminal of the sampling circuit, and a control electrode connected to a fourth control line, wherein an inverting terminal and the output terminal of the amplification circuit are commonly connected.

6. The light emitting display device of claim 5, wherein the compensation circuit includes an output terminal connected to a reference line of the sub-pixel or a data line of the sub-pixel.

7. The light emitting display device of claim 5, wherein the compensation circuit configured to obtain the first sensing voltage through a sensing node defined between a source electrode of a driving transistor and an organic light-emitting diode when a sensing transistor included in the sub-pixel is turned on.

8. The light emitting display device of claim 5, wherein the first switch is turned on for an active period of the display panel, the second switch is turned on for the active period and an initial period of a blank period of the display panel, the third switch is turned on for a last period of the blank period of the display panel, and the fourth switch is turned on for the initial period of the blank period of the display panel.

9. The light emitting display device of claim 1, wherein the sub-pixel includes:

an organic light-emitting diode emitting light;

a driving transistor configured to generate a driving current to be supplied to the organic light-emitting diode;

a capacitor having a first electrode connected to a gate electrode of the driving transistor, and a second electrode connected to an anode of the organic light-emitting diode;

a switching transistor having a gate electrode connected to a first scan line, a first electrode connected to a first reference line, and a second electrode connected to the gate electrode of the driving transistor; and a sensing transistor having a gate electrode connected to the first scan line, a first electrode connected to a first data line, and a second electrode connected to the anode of the organic light-emitting diode.

10. A light emitting display device, comprising:

a display panel configured to display an image;

a driver configured to drive the display panel; and a compensation circuit configured to apply an initialization voltage to a sub-pixel included in the display panel through a data line or a reference line, obtain a sensing voltage, store the sensing voltage, and integrate the sensing voltage to yield the initialization voltage to be applied to the sub-pixel in a subsequent frame.

11. The light emitting display device of claim 10, wherein the compensation circuit configured to repeat integrating the sensing voltage during every blank period of the display panel.

12. The light emitting display device of claim 10, wherein the compensation circuit comprises:

a first switch having a first electrode connected to a terminal through which the initialization voltage is output, a second electrode connected to a non-inverting terminal of an amplification circuit configured to amplify and output the initialization voltage, and a control electrode connected to a first control line;

a second switch having a first electrode connected to an output terminal of the amplification circuit, a second electrode connected to an output channel, and a control electrode connected to a second control line;

a third switch having a first electrode connected to the output channel, a second electrode connected to one terminal of a sampling circuit configured to store the sensing voltage, and a control electrode connected to a third control line; and a fourth switch having a first electrode connected to the non-inverting terminal of the amplification circuit, a second electrode connected to one terminal of the sampling circuit, and a control electrode connected to a fourth control line, wherein the amplification circuit has an inverting terminal commonly connected to the output terminal.

13. A method for driving a light emitting display device, comprising:

applying an initialization voltage through a sub-pixel for a first blank period of a display panel, wherein a data voltage for displaying an image is not applied to the sub-pixel during a corresponding blank period;

obtaining a first sensing voltage from the sub-pixel and storing the first sensing voltage for the first blank period of the display panel;

outputting the first sensing voltage to the sub-pixel for a second blank period of the display panel; and obtaining a second sensing voltage from the sub-pixel and storing the second sensing voltage for the second blank period of the display panel.

14. The method of claim 13, wherein the second sensing voltage has a level higher than the first sensing voltage.

15. The method of claim 13, wherein the initialization voltage is applied through a data line or a reference line of the sub-pixel.

* * * * *